US009410519B2

(12) United States Patent
Usui et al.

(10) Patent No.: US 9,410,519 B2
(45) Date of Patent: Aug. 9, 2016

(54) HIGH-PRESSURE FUEL PUMP ASSEMBLY MECHANISM

(75) Inventors: Satoshi Usui, Hitachinaka (JP); Shingo Tamura, Hitachinaka (JP); Katsumi Miyazaki, Hitachinaka (JP); Hiroyuki Yamada, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 1040 days.

(21) Appl. No.: 13/125,106

(22) PCT Filed: Oct. 29, 2009

(86) PCT No.: PCT/JP2009/068617

§ 371 (c)(1),
(2), (4) Date: May 19, 2011

(87) PCT Pub. No.: WO2010/050569

PCT Pub. Date: May 6, 2010

(65) Prior Publication Data

US 2011/0253109 A1 Oct. 20, 2011

(30) Foreign Application Priority Data

Oct. 30, 2008 (JP) ..... 2008-279041

(51) Int. Cl.
*F02M 59/44* (2006.01)
*F04B 1/04* (2006.01)
(Continued)

(52) U.S. Cl.
CPC ..... *F02M 59/44* (2013.01); *F02M 39/02* (2013.01); *F04B 1/0408* (2013.01);
(Continued)

(58) Field of Classification Search
CPC ..... F04B 9/025; F04B 9/042; F04B 35/01; F04B 39/122; F04B 39/127; F04B 53/16; F04B 1/053; F04B 1/0421; F04B 1/0439; F04B 27/0409; F04B 27/0423; F04B 27/0442; F04B 27/053; F04B 1/0448; F04B 1/0408; F04B 1/0426; F02M 39/02; F02M 59/102; F02M 59/44; F02M 59/48; F02M 59/485
USPC ..... 123/509, 548, 495, 499, 500, 501, 502, 123/503, 504, 508, 514; 417/273, 470
See application file for complete search history.

(56) References Cited

U.S. PATENT DOCUMENTS 4,986,728 A * 1/1991 Fuchs ..... F02M 59/30 123/506
5,685,519 A 11/1997 Bircann et al.
(Continued)

FOREIGN PATENT DOCUMENTS

DE 10322599 A1 * 12/2004 ..... F02M 59/102
DE 103 44 459 A1 4/2005
(Continued)

OTHER PUBLICATIONS

Japanese Office Action dated Aug. 28, 2012 (three (3) pages).
(Continued)

*Primary Examiner* — Stephen K Cronin
*Assistant Examiner* — Brian Kirby
(74) *Attorney, Agent, or Firm* — Crowell & Moring LLP

(57) ABSTRACT

A high-pressure fuel pump includes a pump housing formed with a recess, a cylinder combined with the pump housing to define the recess as a pressurizing chamber, a holder securing the cylinder to the pump housing, and a plunger sliding against the cylinder to pressurize fluid in the pressurizing chamber. The holder includes an outer cylindrical surface portion fitted to an attachment fitting hole of an engine block of an internal combustion engine, and a cylindrical fitting portion fitted to an outer circumference of the cylinder. The outer cylindrical surface portion and the cylindrical fitting portion are formed in a single piece resulting from machining one and the same member.

19 Claims, 12 Drawing Sheets

(51) Int. Cl.
*F02M 39/02* (2006.01)
*F02M 59/10* (2006.01)
*F02M 59/36* (2006.01)

(52) U.S. Cl.
CPC ..... *F04B 1/0421* (2013.01); *F04B 1/0439* (2013.01); *F02M 59/102* (2013.01); *F02M 59/366* (2013.01); *F02M 2200/02* (2013.01); *F02M 2200/85* (2013.01)

(56) References Cited

U.S. PATENT DOCUMENTS 5,921,760 A * 7/1999 Isozumi ..... F02M 39/02 417/470
6,048,180 A * 4/2000 Konishi ..... F02M 63/0225 123/495
6,062,830 A * 5/2000 Kikuchi ..... F02M 55/04 417/540
6,213,094 B1 * 4/2001 Onishi ..... F02M 59/462 123/447
6,217,299 B1 * 4/2001 Jay ..... F02M 59/102 123/495
6,254,364 B1 * 7/2001 Onishi ..... F04B 11/0091 138/26
6,379,132 B1 * 4/2002 Williams ..... F02M 45/12 123/90.16
6,871,578 B1 * 3/2005 Onishi ..... F02M 59/102 92/129
7,024,980 B2 * 4/2006 Uryu ..... F02M 59/102 92/129
7,124,738 B2 * 10/2006 Usui ..... F02M 55/04 123/446
7,165,534 B2 * 1/2007 Usui ..... F02M 55/04 123/456
7,281,519 B2 * 10/2007 Schroeder ..... F02M 59/04 123/445
7,744,353 B2 * 6/2010 Yamada ..... F02M 59/102 417/273
7,757,663 B2 * 7/2010 Usui ..... F02D 41/20 123/446
8,382,458 B2 * 2/2013 Hashida ..... F02M 59/102 417/269
8,579,611 B2 * 11/2013 Lucas ..... F02M 59/02 417/437
8,672,652 B2 * 3/2014 Munakata ..... B23K 11/16 417/437
2004/0052652 A1 * 3/2004 Yamada ..... F02M 59/102 417/273
2006/0201485 A1 * 9/2006 Usui ..... F02D 41/20 123/458
2007/0110603 A1 * 5/2007 Usui ..... F04B 53/1017 417/505
2008/0019853 A1 * 1/2008 Hashida ..... F02M 59/102 417/490
2008/0056914 A1 * 3/2008 Usui et al. ..... 417/307
2008/0213112 A1 * 9/2008 Lucas ..... F02M 59/02 417/471
2008/0289713 A1 * 11/2008 Munakata ..... F02M 55/04 138/26
2009/0110575 A1 * 4/2009 Munakata ..... B23K 11/16 417/437
2009/0288639 A1 * 11/2009 Usui ..... F02M 55/04 123/457
2010/0126474 A1 * 5/2010 Siegel ..... F02M 59/34 123/508

FOREIGN PATENT DOCUMENTS

EP 1 519 033 A2 3/2005
EP 1519033 A2 * 3/2005 ..... F02M 59/06
GB 2188103 A * 9/1987 ..... F02M 59/24
JP 8-105566 A 4/1996
JP 2001-221129 A 8/2001
JP 2004-211574 A 7/2004
JP 2008002361 A * 1/2008 ..... F02M 59/44

OTHER PUBLICATIONS

English translation of International Preliminary Report on Patentability (five (5) pages).
International Search Report with partial English translation dated Dec. 15, 2009 (three (3) pages).
Form PCT/IPEA/409 dated Jan. 20, 2011 (fifteen (15) pages).

* cited by examiner

HIGH-PRESSURE FUEL PUMP ASSEMBLY MECHANISM

TECHNICAL FIELD

The present invention relates to a high-pressure fuel pump for an internal combustion engine assembled to an engine block of the engine, and in particular to its assembly mechanism.

BACKGROUND ART

In the high-pressure fuel pump assembly mechanism described in EP-1519033A2, a holder (46) having an external cylindrical surface portion (46) fitted to a mounting hole (48) formed in an engine. In addition, the assembly mechanism is configured such that a plunger seal member is held by an internal cylindrical surface portion of the holder (46).

In accordance with the assembly mechanism, the outer cylindrical surface portion and the inner cylindrical surface portion can be formed by machining a single member. Therefore, the respective centers of the external cylindrical surface portion and of the inner cylindrical surface portion can be machined coaxially with each other.

PRIOR-ART DOCUMENT

Patent Document

Patent Document 1: EP-1519033A2

SUMMARY OF THE INVENTION

Problem to be Solved by the Invention

It is not guaranteed that an assemblage is conducted such that a central axis of a cylinder (a guide area: 32) fitted to a pump housing (28) and a central axis of a plunger (a piston: 40) inserted through the cylinder (the guide area: 32) are coaxial with the central axis of the holder (46).

For this reason, side force tends to be applied to the plunger (the piston: 40); therefore, there is a possibility that biting or wear may occur at a slide portion located between the cylinder (the guide area: 32) and the plunger (the piston: 40). The parenthetic symbols denote reference numerals or the like described in patent document 1.

It is an object of the present invention to make it possible to accurately position a cylinder of a high-pressure fuel pump with respect to a mounting-fitting hole provided in an engine block of an internal combustion engine, in mounting the pump to the engine block.

Means for Solving the Problem

A high-pressure fuel pump of the present invention is provided with a holder including an outer cylindrical surface portion fitted to a high-pressure fuel pump attachment fitting hole provided in an engine block of an internal combustion engine and including a cylindrical fitting portion fitted to an outer circumference of the cylinder of the pump. The holder is configured such that the outer cylindrical surface portion and the cylindrical fitting portion are formed in a single piece resulting from machining one and the same member.

Effect of the Invention

The high-pressure fuel pump of the present invention is configured as described above. Therefore, the central axis of the insertion hole of the piston plunger installed in the cylinder easily provides coaxiality with respect to the central axis of the attachment fitting hole installed in the engine block of the internal combustion engine. Biting and wear between the cylinder and the piston plunger caused by the side force applied to the piston plunger by a drive mechanism can be reduced.

MODE FOR CARRYING OUT THE INVENTION

Figure 1:
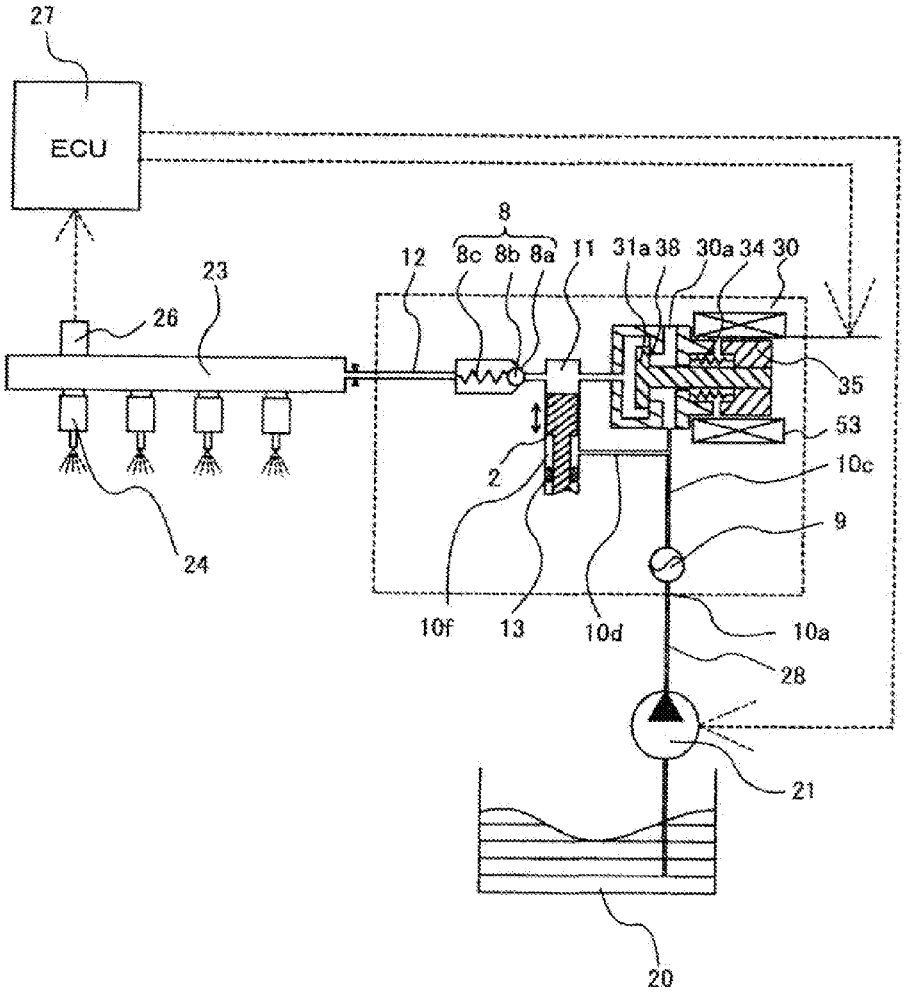
FIG. 1 illustrates an example of a fuel supply system using a high-pressure fuel pump according to a first embodiment of the present invention.

A basic configuration of an embodiment of the present invention is as described below. The parenthetic symbols denote reference numerals of portions relating to the embodiment just for reference.

A pump housing (1) is formed with a bottomed recess (1A) at a central portion thereof. A tubular cylinder (6) is combined with an inner circumferential cylindrical portion of the recess (1A) on the opening end side thereof to define the recess (1A)

as a pressurizing chamber (11). A piston plunger sliding with respect to the cylinder (6) and pressurizing the fluid in the pressurizing chamber (11) reciprocates to suck fuel into the pressurizing chamber (11). The fuel pressurized in the pressurizing chamber (11) is discharged from a discharge port (12) via a discharge valve unit (8).

A cylinder holder (7) includes an outer cylindrical surface portion (7*b*) fitted to an attachment fitting hole (70) of an engine block (100) of an internal combustion engine. Further, the cylinder holder (7) includes a cylindrical fitting portion (7*a*) fitted to the outer circumference of the cylinder (6). The outer cylindrical surface portion (7*b*) and the cylindrical fitting portion (7*a*) are formed in a single piece resulting from machining one and the same member.

In the high-pressure fuel pump of the embodiment configured as above, an attachment fitting hole (70) provided in the engine block (100) functions as a positioning cylindrical portion between the engine block (100) and the outer circumference of the cylinder holder (7). Therefore, the central axis of an insertion hole of the piston plunger (2) installed in the cylinder (6) easily provides coaxiality with respect to the central axis of the attachment fitting hole (70) installed in the engine block (100) of the internal combustion engine. Consequently, biting and wear caused by sliding between the cylinder (6) and the piston plunger (2), which are due to side force applied to the piston plunger (2) by a drive mechanism, can be reduced.

Preferably, the outer cylindrical surface portion (7*b*) and the cylinder fitting portion (7*a*) are each formed of a cylindrical surface whose axial center coincides with the central axis of the insertion hole of the piston plunger (2) formed in the cylinder (6).

Preferably, the cylinder (6) is brought into pressure contact with the pump housing (1). At this pressure contact portion, a seal portion (6*a*) resulting from metal contact is formed to thus define the pressurizing chamber (11). In addition, the cylinder holder (7) is configured to function as securing means for bringing the cylinder (6) and the pump housing (1) into pressure contact with each other. Circumferential pressing force resulting from press fitting can be used as the securing means for press contact. Also swaging can be used.

Preferably, a second seal member (61) forming a seal portion in cooperation with the inner circumferential surface of the attachment fitting hole (70) of the engine block (100) is attached to the outer cylindrical surface portion (7*b*) of the cylinder holder (7). While their axial centers are aligned with each other, the seal for each portion can be achieved.

Preferably, a seal member (13) attached to the outer circumferential surface, of the piston plunger (2), on a side opposite the pressurizing chamber (11) is provided. The cylinder holder (7) is provided with an inner cylindrical surface portion (7*c*) into which the seal member (13) is housed. With this configuration, the axial centers of the seal member (13) for the piston plunger and of the piston plunger (2) can accurately be aligned with each other.

Preferably, the outer cylindrical surface portion (7*b*), the inner cylindrical surface portion (7*c*) and the cylindrical fitting portion (7*a*) are formed in a single piece resulting from machining one and the same member. With this configuration, their three axial centers can accurately be aligned with one another.

Preferably, the outer cylindrical surface portion (7*b*), the inner cylindrical surface portion (7*c*) and the cylindrical fitting portion (7*a*) are formed to have the same axial center. With this configuration, their three axial centers can accurately be aligned with one another.

Preferably, an adjusting gap (1B) is provided between the inner circumferential surface of the pump housing (1) defining the pressurizing chamber (11) and the outer circumferential surface of the cylinder (6) projecting into the pressurizing chamber (11). With this configuration, even if the pump housing (1) is inwardly expanded by heat, the gap can absorb the deformation of the pump housing. Therefore, side force will not be applied to the piston plunger (2) located at the center. In addition, the cylinder will not be deformed inwardly by the reaction force resulting from external expansion.

A third seal member (62) is installed between the outer circumferential surface of the cylinder holder (7) and the pump housing (1), i.e., in an outer circumferential groove (7*f*) of the cylinder holder (7). With this configuration, the sealing between the cylinder holder (7) and the pump housing (1) can be achieved.

Preferably, the seal portion (6*a*) resulting from the metal contact is formed of the metal contact portion between the pump housing (1) and the cylinder (6) to define the pressurizing portion (11). In addition, a leakage of fuel from a portion between the cylinder (6) and the piston plunger is sealed by the seal member (13) attached to the outer circumference of the piston plunger (2) extending outwardly from a sliding portion between the cylinder (6) and the piston plunger (2). The seam member (13) is secured to the inner cylindrical surface portion (7*c*) of the cylinder holder (7). With this configuration, the plunger seal holder and the cylinder holder can be shared.

Preferably, the piston plunger (2) is configured to be able to advance into and retreat from the inside of the pressurizing chamber formed in the pump housing (1) beyond the distal end of the cylinder (6). With this configuration, the piston plunger (2) projecting into the pressurizing chamber (11) is cooled by the fuel in the pressurizing chamber. Therefore, sliding wear at the sliding hole of the cylinder (6) can be reduced. The sliding portion between the cylinder (6) and the piston plunger (2) can be made close to the axial central portion of the piston plunger (2), thereby suppressing the inclination of the piston plunger (2).

Preferably, the metal contact seal portion (6*a*) is formed by bringing the pump housing (1) and the cylinder (6) into pressure contact with each other at a plane crossing the movement direction of the piston plunger (2). A pressing mechanism (the cylinder holder (7) in the embodiment) is provided that relatively presses the pump housing (1) and the cylinder (6) toward the metal contact seal portion (6*a*). With this configuration, the force used for the sealing can be increased to provide reliable sealing. As the pressing mechanism, the lower end of the cylinder can be subjected to swage toward the seal surface.

Preferably, the pressing mechanism (the cylinder holder (7) in the embodiment) is composed of a screw portion (7*g*) formed on the outer circumference of the cylinder holder (7) and a second screw portion (1*b*) formed on the pump housing 1 so as to be threadedly engaged with the screw portion. With this configuration, sealing force can simply be obtained by screwing the cylinder holder (7).

Preferably, securing means (41, 42, 43, 44) for securing the pump housing (1) to the engine block (100) of the internal combustion engine is provided.

Other characteristic configurations of the high-pressure fuel pump of the embodiment according to the invention are as below.

A high-pressure fuel pump includes: a pump housing (1) formed with a recess (1A); a cylinder (6) combined with the pump housing (1) to define the recess (1A) as a pressurizing chamber (11); and a piston chamber (2) sliding against the cylinder (6) to pressurize fluid in the pressurizing chamber (11), wherein reciprocation of the piston plunger (2) pressurize the fuel sucked into the pressurizing chamber (11) to discharge the fuel from the pressurizing chamber (11). The high-pressure fuel pump includes a seal member (13) attached to an outer circumferential surface on a side opposite the pressurizing chamber (11) of the piston plunger (2), and a holder (a cylinder holder (7) in the embodiment) housing the seal member (13), wherein the holder (the cylinder holder (7) in the embodiment) includes an outer cylindrical surface portion (7*b*) fitted to an attachment fitting hole (70) of an engine block (100) of an internal combustion engine, and an inner cylindrical surface portion (7*c*) housing the seal member (13). The holder (the cylinder holder (7) in the embodiment) is provided with a cylindrical fitting portion (7*a*) fitted to an outer circumference of the cylinder (6). The outer cylindrical surface portion (7*b*), the inner cylindrical surface portion (7*c*) and the cylindrical fitting portion (7*a*) are formed in a single piece resulting from machining one and the same member.

With this configuration, the plunger seal holder and the cylinder holder are formed integrally with each other and the cylinder holder is formed with a fitting portion with the attachment fitting hole of the engine block (100). Therefore, three central axes of the above three can easily be allowed to coincide with one another.

Preferably, the outer cylindrical surface portion (7*b*), the inner cylindrical surface portion (7*c*) and the cylindrical fitting portion (7*a*) are formed of respective cylindrical surfaces whose axial centers coincide with a central axis of a piston plunger (2) insertion hole formed in the cylinder (6). With this configuration, the three central axes of the three can further easily be allowed to coincide with one another.

Other characteristic configurations of the high-pressure fuel pump of the embodiment according to the invention are as below.

A high-pressure fuel pump includes: a pump housing (1) formed with a recess (1A); a cylinder (6) combined with the pump housing (1) to define the recess (1A) as a pressurizing chamber (11); and a piston chamber (2) sliding against the cylinder (6) to pressurize fluid in the pressurizing chamber (11), wherein reciprocation of the piston plunger (2) pressurize the fuel sucked into the pressurizing chamber (11) to discharge the fuel from the pressurizing chamber (11). The high-pressure fuel pump includes: a seal member (13) attached to an outer circumferential surface on a side opposite the pressurizing chamber (11) of the piston plunger (2); and a holder (a cylinder holder (7) in the embodiment) housing the seal member (13), wherein the holder (the cylinder holder (7) in the embodiment) includes an outer cylindrical surface portion (7*b*) fitted to an attachment fitting hole (70) of an engine block (100) of an internal combustion engine, and an inner cylindrical surface portion (7*c*) housing the seal member (13), and the outer cylindrical surface portion (7*b*) and the inner cylindrical surface portion (7*c*) are formed of respective cylindrical surfaces whose axial centers coincide with a central axis of an insertion hole of the piston plunger (2) formed in the cylinder (6).

In the case of the configuration as described above, the axial centers of the inner and outer cylindrical portions of the plunger seal holders can accurately be aligned with each other.

Embodiments will hereinafter be described in further detail with reference to the drawings.

First Embodiment

An embodiment of the present invention is described with reference to FIGS. 1 to 12.

Referring to FIG. 1, a portion surrounded by a broken line indicates a pump housing 1 of a high-pressure pump. Mechanisms and component parts illustrated in the broken line are integrally assembled in the pump housing 1 of the high-pressure pump.

Fuel in a fuel tank 20 is pumped up by a feed pump 21 on the basis of a signal from an engine control unit 27 (hereinafter referred to as the ECU), pressurized to an appropriate feed-pressure, and supplied to an inlet port 10*a* of a high-pressure fuel pump trough a suction pipe 28.

The fuel having passed through the inlet port 10*a* passes through a filter 102 secured to the inside of an inlet joint 101 and reaches an inlet port 30*a* of an electromagnetically-driven valve mechanism 30 constituting a capacity variable mechanism through metal diaphragm dampers 9 and 10*c*.

The intake filter 102 in the inlet joint 101 has a role of preventing foreign particles existing between the fuel tank 20 and the inlet port 10*a* from entering the inside of the high-pressure fuel pump along with the fuel flow.

Figure 4:
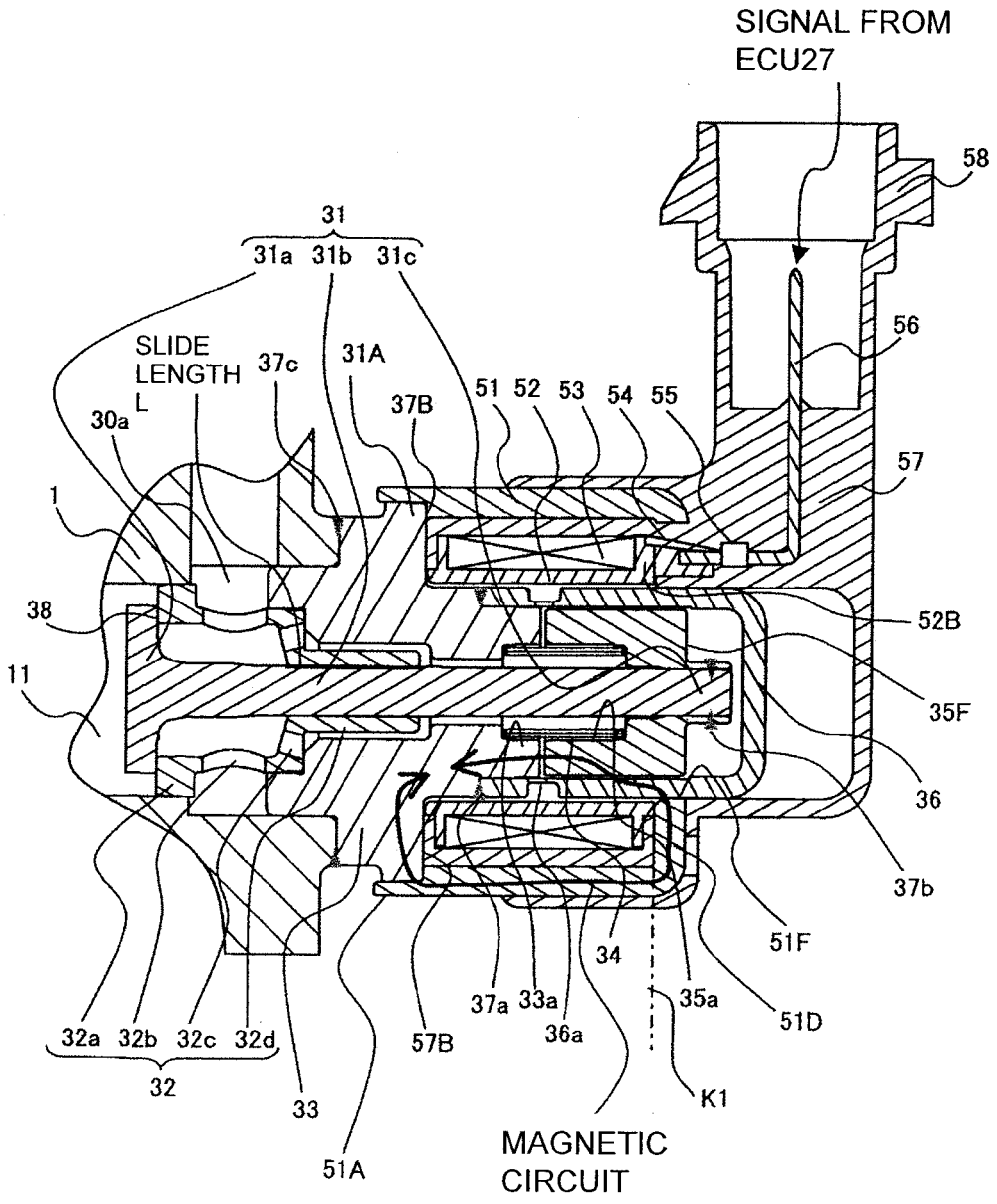
FIG. 4 is an enlarged view of an electromagnetic inlet valve of the high-pressure fuel pump mechanism according to the first embodiment of the invention, illustrating the state where an electromagnetic coil is not energized.

FIG. 4 is an enlarged view of the electromagnetic inlet valve mechanism 30, illustrating a state where an electromagnetic coil 53 is not energized.

Figure 5:
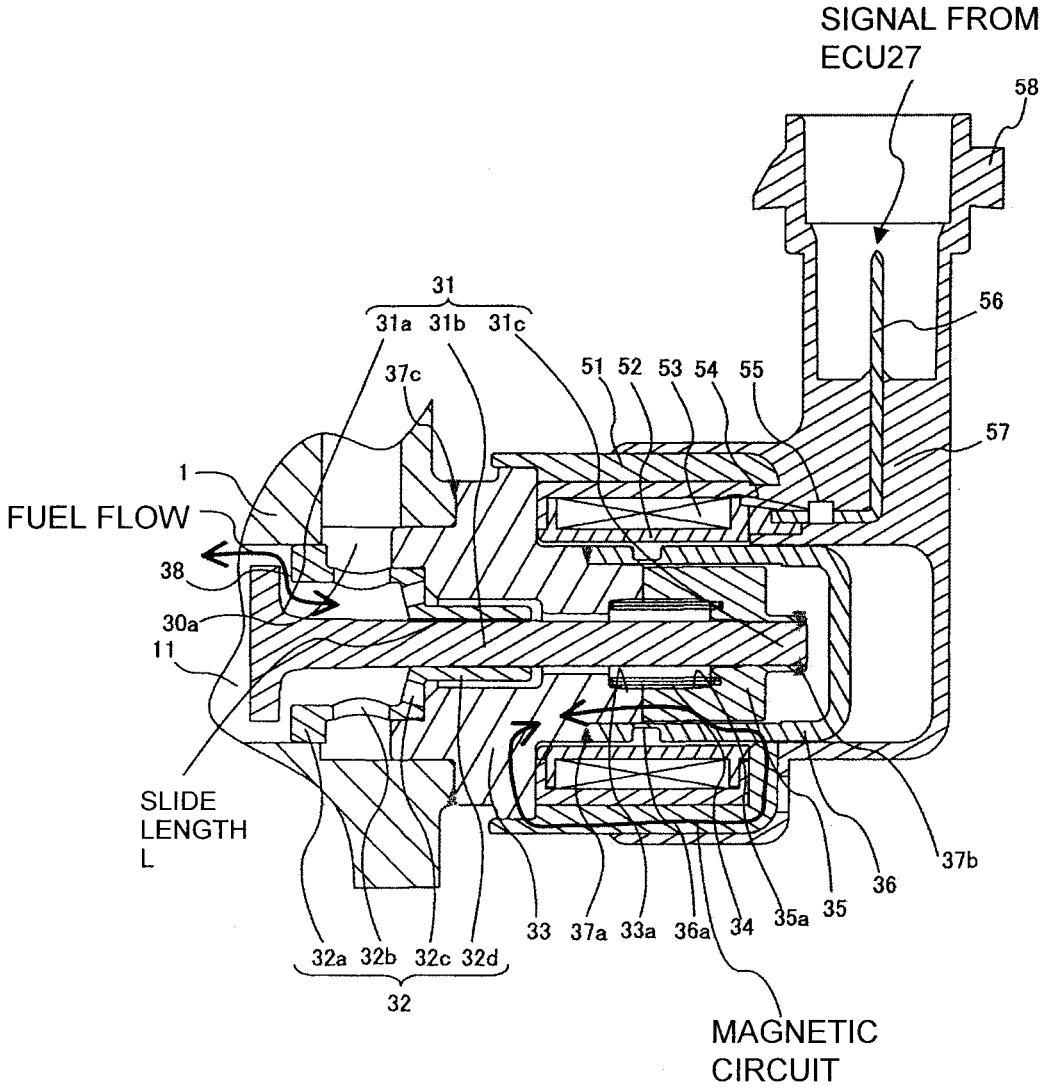
FIG. 5 is an enlarged view of the electromagnetic inlet valve of the high-pressure fuel pump mechanism according to the first embodiment of the invention, illustrating the state where the electromagnetic coil is energized.

FIG. 5 is an enlarged view of the electromagnetic inlet valve mechanism 30, illustrating a state where the electromagnetic coil 53 is energized.

The pump housing 1 is centrally formed with a protruding portion 1A serving as a pressurizing chamber 11. In addition, a hole 30A adapted to receive the electromagnetic inlet valve mechanism 30 mounted thereinto is formed in the pump housing 1 so as to communicate with the pressurizing chamber 11.

A plunger rod 31 constituting the movable plunger is composed of three portions: an inlet valve portion 31*a*, a rod portion 31*b*, and an anchor-securing portion 31*c*. The anchor 35 is fixedly welded to the anchor-securing portion 31*c* through a welded portion 37*b*.

As illustrated in the figures, a spring member 34 is fitted into an anchor inner circumference 35*a* and into a first core portion inner circumference 33*a* so as to generate a spring force acting in a direction of moving the anchor 35 and the first core portion 33 away from each other.

A valve seat member 32 is composed of an inlet valve seat portion 32*a*, an intake passage portion 32*b*, a press-fitting portion 32*c*, and a sliding bearing portion 32*d*. The press-fitting portion 32*c* is fixedly press fitted into the annular recess of one end of the first core portion 33.

The press-fitting portion 32*c* is provided with a plurality of small holes 32*e*. A gap is defined between the outer circumference of the sliding bearing portion 32*d* and the inner circumferential surface of the first core portion 33 so as to communicate with the intake passage portion 32*b* through the small holes 32*e*, allowing for entrance and exit of fluid (fuel).

The inlet valve seat portion 32*a* is fixedly press fitted into the pump housing 1 to form a press-fitting portion, which completely isolates the pressurizing chamber 11 and the inlet port 30*a* from each other.

The first core portion 33 is fixedly welded to the pump housing 1 through the welded portion 37*c* to isolate the inlet port 30*a* and the outside of the high-pressure fuel pump from each other.

The second core portion 36 is composed of a cap member made of a magnetic material and is fixedly welded at the opening end side to the first core portion 33 through the welded portion 37*a*.

An inner space defined by the first core portion 33 and the second core portion 36 is completely isolated from an outer space. The second core portion 36 is provided on the outer circumferential surface with a magnetic orifice portion 36*a* composed of an annular groove.

In the de-energized state where the electromagnetic coil 53 is not energized, when there is no difference in fluid pressure between the intake passage 10*c* (the inlet port 30*a*) and the pressurizing chamber 11, the plunger rod 31 is displaced rightward as shown in FIG. 4 by the spring 34. This state is a valve-closed state where the inlet valve portion 31*a* and the inlet valve seat portion 32*a* are brought into contact with each other, closing the intake port 38.

Figure 2:
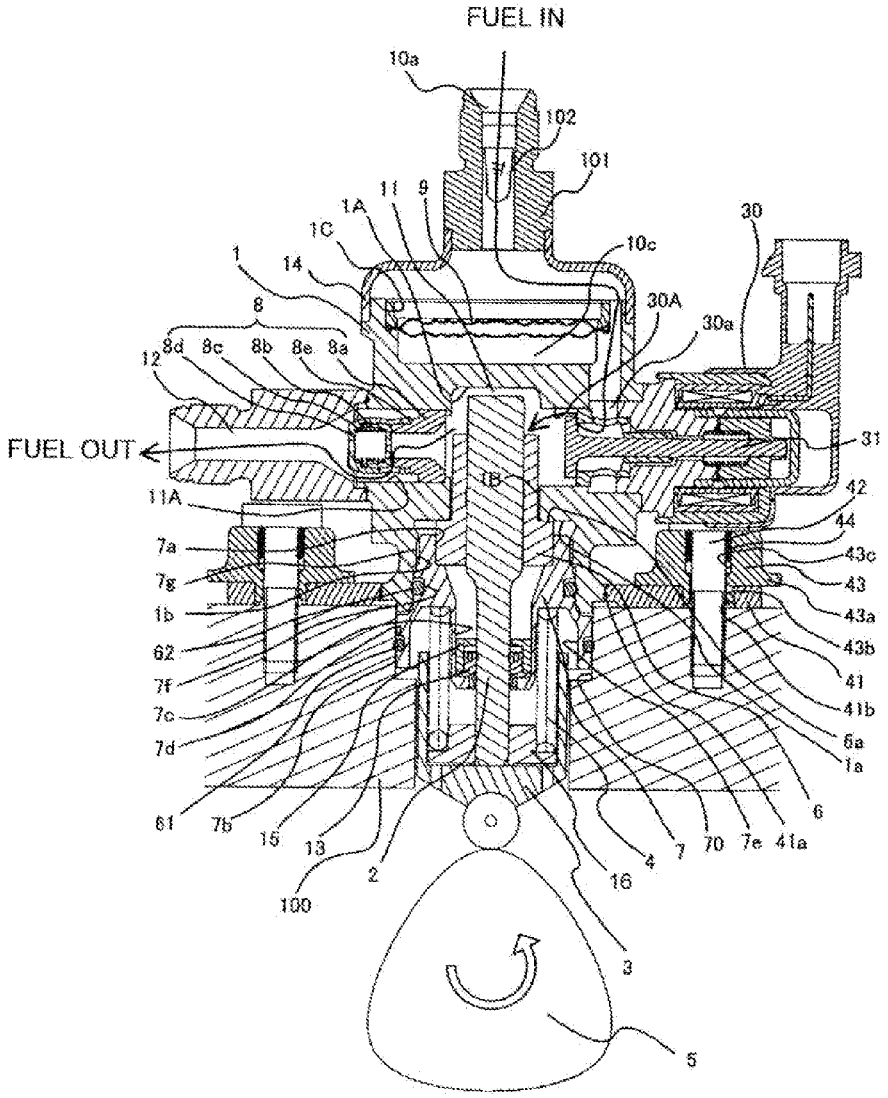
FIG. 2 is a longitudinal cross-sectional view of the high-pressure fuel pump according to the first embodiment of the invention.
Figure 3:
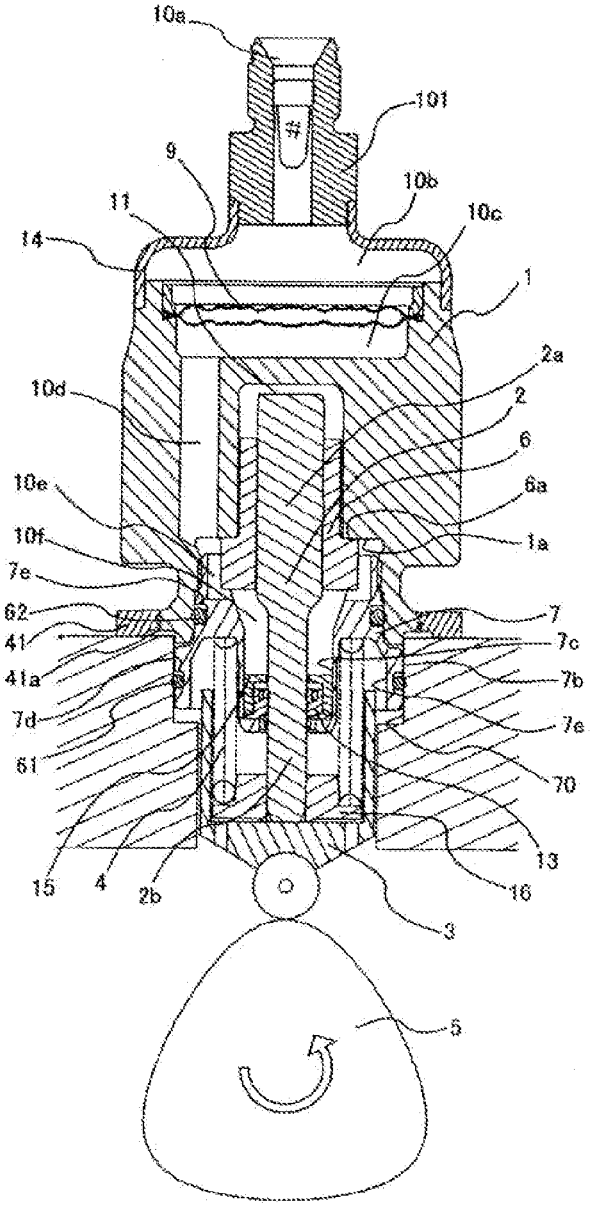
FIG. 3 is a longitudinal cross-sectional view of the high-pressure fuel pump according to the first embodiment of the invention as viewed from another angle, illustrating a longitudinal cross-section at a position circumferentially offset from that in FIG. 2 by 90°.

Rotation of a cam described later leads to the state of the intake process where the piston plunger 2 is displaced downward in FIG. 2. In this state, the pressurizing chamber 11 is increased in capacity to reduce the fuel pressure therein. In this process, the fuel pressure in the pressurizing chamber 11 becomes lower than the pressure in the intake passage 10*c* (the inlet port 30*a*). Thus, at the inlet valve portion 31*a*, a valve-opening force (force displacing the inlet valve portion 31*a* leftward in FIG. 1) is generated due to the fluid differential pressure of fuel.

The inlet valve portion 31*a* is set such that the valve-opening force resulting from the fluid differential pressure opens the intake port 38, overcoming the biasing force of the spring member 34. When the fluid differential pressure is large, the inlet valve portion 31*a* is fully opened and the anchor 31 comes into contact with the first core portion 33. When the fluid differential pressure is small, the inlet valve portion 31*a* is not fully opened and the anchor 31 does not come into contact with the first core portion 33.

In this state, when a control signal from the ECU 27 is applied to the electromagnetic inlet valve mechanism 30, an electric current flows in the electromagnetic coil 53 of the electromagnetic inlet valve mechanism 30 to generate an attractive magnetic biasing force between the first core portion 33 and the anchor 31. Consequently, the magnetic biasing force is applied to the plunger rod 31 leftward in the figures.

When the inlet valve portion 31*a* is fully opened, its opened state is maintained. On the other hand, when the inlet valve portion 31*a* is not fully opened, the opening movement of the inlet valve portion 31*a* is assisted to fully open the inlet valve portion 31*a*. That is to say, the anchor 31 comes into contact with the first core portion 33. Thereafter, this state is maintained.

Consequently, the inlet valve portion 31*a* is maintained in the state where the intake port 38 is opened. Fuel passes through the intake passage portion 32*b* of the valve seat member 32 and the intake port 38 from the inlet port 30*a* and flows into the pressurizing chamber 11.

The intake process of the piston plunger 2 is ended while the application of the input voltage to the electromagnetic inlet valve mechanism 30 is maintained. The intake process is shifted to the compression process in which the piston plunger 2 is displaced upward in FIG. 2. In the compression process, since the magnetic biasing force remains maintained, the inlet valve portion 31*a* remains opened.

The capacity of the pressurizing chamber 11 is reduced along with the compressive movement of the piston chamber 2. In this state, however, the fuel sucked once into the pressurizing chamber 11 is returned to the intake passage 10*c* (the inlet port 30*a*) again through the intake port 38 that is in the opened state. Therefore, the pressure in the pressurizing chamber 11 will not rise. This process is called a return process.

In this state, if the control signal from the ECU 27 is cancelled to de-energize the electromagnetic coil 53, the magnetic biasing force acting on the plunger rod 31 disappears after a given period of time (after a magnetic and mechanical delay time). Since the biasing force of the spring member 34 acts on the inlet valve portion 31*a*, when the electromagnetic force acting on the plunger rod 31 disappears, the inlet valve portion 31*a* closes the intake port 38 through the biasing force of the spring 34. If the intake port 38 is closed, from this time, the fuel pressure in the pressurizing chamber 11 rises along with the upward movement of the piston plunger 2. When the fuel pressure in the pressurizing chamber 11 exceeds the pressure in the fuel discharge port 12, the fuel left in the pressurizing chamber 11 is discharged at high pressure through the discharge valve unit 8 to a common rail 23. This process is called a discharged process. That is to say, the compression process (the elevation process between lower dead center and upper dead center) by the piston plunger 2 consists of the return process and the discharge process.

The amount of high-pressure fuel to be discharged can be controlled by controlling timing to cancel the energization of the electromagnetic coil 53 of the electromagnetic inlet valve mechanism 30.

If the timing to cancel the energization of the electromagnetic coil 53 is advanced, in the compression process, the return process has a small proportion whereas the discharge process has a large one.

In other words, fuel to be returned to the intake passage 10*c* (the inlet port 30*a*) is in a small amount, whereas fuel to be discharged at high pressure is in a large amount.

On the other hand, if the timing to cancel the input voltage is delayed, in the compression process, the return process has a large proportion whereas the discharge process has a small one. In other words, fuel to be returned to the intake passage 10*c* is in a large amount, whereas fuel to be discharged at high pressure is in a small amount. The timing to cancel the energization of the electromagnetic coil 53 is controlled by an instruction from the ECU.

With such a configuration, controlling timing to cancel the energization of the electromagnetic coil 53 can control the amount of fuel to be discharged at high pressure to the amount necessary for the internal combustion engine.

The fuel led through the fuel inlet port 10*a* to the pressurizing chamber 11 of the pump housing 1 is highly pressurized in a desired amount by the reciprocation of the piston plunger 2 and then supplied under pressure to the common rail 23 from the fuel discharge port 12.

Injectors 24 and a pressure sensor 26 are attached to the common rail 23. The number of the injectors 24 thus attached is made equal to that of cylinders of the internal combustion engine. In response to the control signals from the engine control unit (ECU) 27 the injectors 24 inject fuel into the corresponding cylinders while being opened and closed.

In this case, along with the upward and downward movements of the piston plunger 2 the inlet valve portion 31*a* repeats the opening and closing operations for the intake port 38, and the plunger rod 31 repeats leftward and rightward movements in the figures. The movement of the plunger rod 31 is limited only to the leftward and rightward movements in FIGS. 4 to 6 by the sliding bearing portion 32*d* of the valve seat member 32. The sliding bearing'portion 32*d* and the rod portion 31*b* repeat sliding movement therebetween. Therefore, the sliding portion needs sufficiently low surface roughness so as not to act as resistance against the sliding movement of the plunger rod 31. The clearance of the sliding portion is selected as below.

If the clearance is too large, the plunger rod 31 may swing around the sliding portion like a pendulum, whereby the anchor 35 and the second core portion 36 come into contact with each other. If the plunger rod 31 slidably moves, also the anchor 35 and the second core portion 36 may slide with each other, which increases resistance resulting from the sliding movement of the plunger rod 31. Thus, the responsiveness of the opening and closing movement for the intake port 38 becomes poor. Since the anchor 35 and the second core portion 36 are made of ferritic magnetic stainless steel, if they slide with each other, it is probable that wear powder and the like may be produced. As described later, the smaller the gap between the anchor 35 and the second core portion 36, the larger the magnetic biasing force. If the gap is too large, the magnetic biasing force is insufficient, which makes it impossible to appropriately control the amount of fuel to be discharged at high pressure. In view of such circumstances, it is necessary to make the gap between the anchor 35 and the second core portion 36 as small as possible and to prevent them from coming into contact with each other.

To meet the necessity, the sliding portion is made single and further a sliding length L of the sliding bearing portion 32*d* is made sufficiently long as shown in FIGS. 4 and 5. The sliding portion is formed of the inner diameter of the sliding bearing portion 32*d* and the outer diameter of the rod portion 31*b*. Machining any of them inevitably needs tolerance and also the clearance of the sliding portion inevitably needs tolerance. On the other hand, the clearance between the anchor 35 and the second core portion 36 has an upper limit because of the magnetic biasing force as described above. To accommodate the tolerance of the clearance and to prevent the anchor 35 and the second core portion 36 from coming into contact with each other, it is needed only to make the sliding length L longer, thereby reducing the pendulum motion.

In this way, when the plunger rod 31 is about to move like a pendulum, the sliding bearing portion 32*d* and the rod portion 31*b* come into contact and slide with each other at both ends of the sliding portion. Therefore, the clearance between the anchor 35 and the second core portion 36 can be made small.

If the clearance is too small, during the closed state of the intake port 38, the inlet valve portion 31*a* and the inlet valve seat portion 32*a* will not come into full surface contact with each other. This is because the clearance of the sliding portion cannot accommodate the perpendicularity of the inlet valve portion 31*a* and rod portion 31*b* of the plunger rod 31 and that of the inlet valve seat portion 32*a* and sliding bearing portion 32*d* of the valve seat member 32. Unless the inlet valve portion 31*a* and the seat portion 32*a* come into full surface contact with each other, it is probable that the plunger rod 31 may undergo excessive torque to be damaged because of high-pressure fuel in the pressurizing chamber 11 having high pressure during the discharge process. In addition, it is probable that the sliding portion may undergo an excessive load to be damaged or worn.

In view of such circumstances, it is necessary for the inlet valve portion 31*a* and the inlet valve seat portion 32*a* to come into full surface contact with each other in the closed state of the intake port 38. In particular, since the increased sliding length L intends to suppress the pendulum movement of the plunger rod 31 as described above, accuracy is increased that is desired by the perpendicularity of the inlet valve portion 31*a* and rod portion 31*b* of the plunger rod 31 and that of the inlet valve seat portion 32*a* and sliding bearing portion 32*d* of the valve seat member 32.

For this reason, the inlet valve seat portion 32*a* and the sliding bearing portion 32*d* are provided on the valve seat member 32. The inlet valve seat portion 32*a* and the sliding bearing portion 32*d* are made of one and the same member so as to have the accurate perpendicularity. If the inlet valve seat member 32*a* and the sliding bearing portion 32*d* are made of different members each other, causes of poor perpendicularity occur at machined and joined portions. This problem can be solved by the inlet valve seat portion 32*a* and the sliding bearing portion 32*d* being made of a single member.

If the magnetic biasing force generated by the energization of the electromagnetic coil 53 is insufficient, the amount of fuel discharged at high pressure cannot appropriately be controlled. Therefore, the magnetic circuit formed around the electromagnetic coil 53 should be one that can generate a sufficient magnetic biasing force.

In other words, a magnetic circuit is desired to flow much more magnetic flux when the electromagnetic coil 53 is energized to produce a magnetic field therearound. In general, the thicker and shorter the magnetic circuit is, the smaller magnetic resistance is. Therefore, magnetic flux passing through the magnetic circuit increases to increase a magnetic biasing force generated.

In the present embodiment, as shown in FIG. 5 members constituting the magnetic circuit are the anchor 35, the first core portion 33, the yoke 51, and the second core portion 36, all of which are magnetic materials.

The first core portion 33 and the second core portion 36 are joined together by welding at the welded portion 37*a*. However, the magnetic flux is required not to directly pass through between the first core portion 33 and the second core portion 36 but to pass through therebetween via the anchor 35. This intends to produce the magnetic biasing force between the first core portion 33 and the anchor 35. If the magnetic flux directly passes through between the first core portion 33 and the second core portion 36 so that magnetic flux passing through the anchor 35 reduces, the magnetic biasing force decreases.

To solve such a problem, a conventional configuration is such that an intermediate member is provided between the first core portion 33 and the second core portion 36. Since the intermediate member is a non-magnetic body, the magnetic flux will not directly pass through between the first core portion 33 and the second core portion 36 but all the magnetic flux passes through the anchor 35.

However, the provision of the intermediate member increases the number of component parts and requires necessity to join the intermediate member to the first core portion 33 and to the second core portion 36, which leads to a problem of increased cost.

To solve the problem, in the present embodiment, the first core portion 33 and the second core portion 36 are directly joined together at the welded portion 37 to form a magnetic orifice portion 36*a* as the annular groove (36*a*) provided on the outer circumference of the second core portion. The magnetic orifice portion 36*a* functions as magnetic resistance in a closed magnetic path. The magnetic orifice portion 36*a* is reduced in thickness as much as possible so far as strength permits. On the other hand, the other portions of the second core portion 36 ensure a sufficient thickness. The magnetic orifice portion 36*a* is disposed close to a portion where the first core portion 33 and the anchor 35 come into contact with each other.

In this way, most of the magnetic flux produced passes through the anchor 37, but the magnetic flux directly passing through between the first core portion 33 and the second core portion 36 is in an extremely small amount. Because of this, the lowering of the magnetic biasing force produced between the first core portion 33 and the anchor 35 is brought into an acceptable range.

While the first core portion 33 and the anchor 35 are in contact with each other, the largest gap in the magnetic circuit is a radial gap formed between the inner circumferential surface of the second core portion 36 and the outer circumferential surface of the anchor 35. Since the radial gap is filled with fuel, the larger the gap, the greater the magnetic resistance of the magnetic circuit. Thus, as the gap is smaller, the magnetic circuit is better.

In the present embodiment, the radial gap between the second core portion 36 and the anchor 35 can be made small by increasing the sliding length L of the sliding portion as described earlier.

The magnetic coil 53 is formed by winding a lead line 54 around an annular or cylindrical resin-made bobbin 52 centered at the axis of the plunger rod 31. Both end portions (a winding-start portion and a winding-end portion) of the lead line 54 are connected to respective different terminals 56 by welding through respective lead line welded portions 55. The terminal 56 is formed of a conductive metal plate, one end of which is attached to one end of the resin bobbin 52 and the other end of which projects toward a connector portion 58.

The connector portion 58 is connected to a counterpart connector associated with the ECU for contact with a counterpart terminal, whereby the coil can be energized.

The electromagnetic coil 53 is housed in the cup-like yoke 51 and thereafter a molding resin is internally and externally injected to the yoke 51, thereby forming the resin molded body 57. The weld joined portion 55 and the electromagnetic coil 53 are buried into the resin except a portion of an open end side inner and outer circumferences of the yoke 51, the inner circumferential surface of the bobbin 52 and a portion of the terminal 56. Thus, the connector portion 58 is formed around the protruding portion of the terminal. In this case, a small gap is defined between the outer circumferential surfaces of the core portions (33, 36) and the inner circumferential surface of the resin molded body (57, 380).

The outer circumferential portion of the second core portion 36 of an inlet valve unit 370 is inserted into the inner circumferential portion of the resin molded body 57 so as to keep a minute gap therebetween. Consequently, even if the resin molded body 57 has a molding tolerance, the outer circumference of the second core portion 36 will not rub the inner circumference of the resin molded body 57. Thus, the resin molded body 57 will not undergo an excessive force to cause no cracks.

Figure 6:
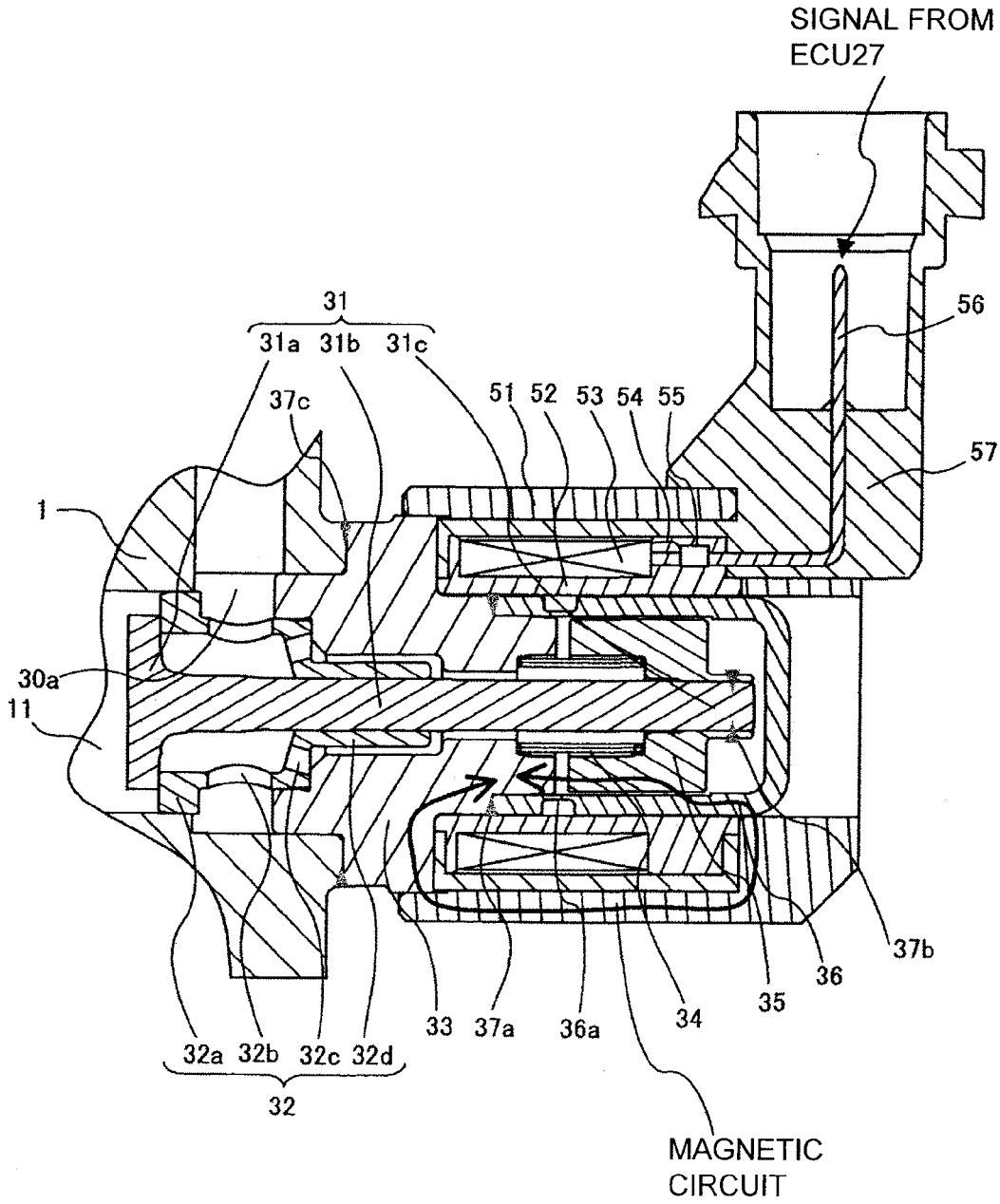
FIG. 6 is an enlarged view of an electromagnetic inlet valve mechanism of the high-pressure fuel pump according to a conventional example, illustrating the state where an electromagnetic coil is not energized.

FIG. 6 illustrates a conventional structure. In the conventional structure, a weld joined portion 55 between a lead line and a terminal end is disposed internal of a magnetic circuit, i.e., of a yoke 51. Therefore, the total length of the magnetic circuit, i.e., the length of the yoke 51 is increased by the axial dimension of the lead line weld joined portion 55. This will increase the magnetic resistance of the magnetic circuit, which leads to a problem with a reduced magnetic biasing force occurring between a first core portion 33 and an anchor 35.

In the present embodiment, the lead line welding joined portion 55 is disposed external of the magnetic circuit, i.e., of the yoke 51. In this way, since there is no need for a space adapted to receive the lead line weld joined portion 55 therein, the total length of the magnetic circuit can be reduced. This can generate a sufficient magnetic biasing force between the first core portion 33 and the anchor 35.

Figure 7:
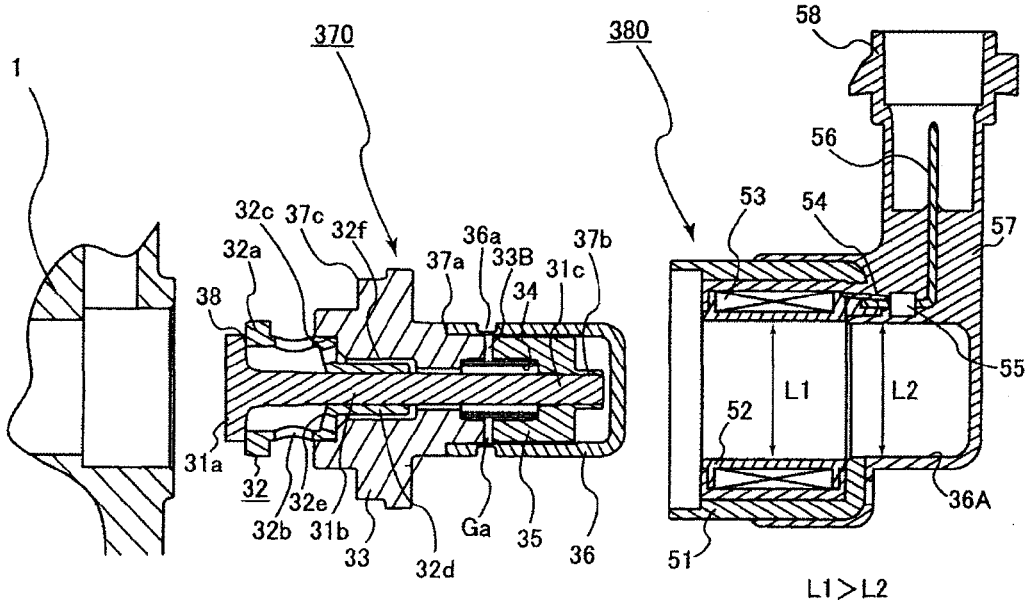
FIG. 7 illustrates a state before the electromagnetic inlet valve of the high-pressure fuel pump mechanism according to the first embodiment of the invention is assembled into a pump housing.

FIG. 7 illustrates a state before the electromagnetic inlet valve mechanism 30 is assembled into the pump housing 1.

In the present embodiment, first, the inlet valve unit 370 and the connector unit 380 are each unitized. (The connector unit 380 is called a connector unit because of having the connector 58, also called the resin molded body 57 because of being molded of resin, and further called the electromagnetic drive mechanism 380 because of having the function of an electromagnetic drive mechanism.) Next, the inlet valve seat portion 32*a* of the inlet valve unit 370 is fixedly press-fitted into the pump housing 1 and thereafter the welded portion 37*c* is full-circumferentially joined by welding. In the present embodiment, the welding is laser welding. In this state, the inner circumferential surface of the thinned-wall portion 51A disposed at the opening end of the yoke member 51 of the connector unit 380 is fixedly press-fitted into the outer circumference of an annular projecting surface 31A of the first core portion 33.

With such a configuration, since the connector unit 380 can be press-fitted into the first core portion 33 at any position of 360 degrees, the orientation of the connector 58 can freely be selected.

Further in the present embodiment, to prevent the outer circumferential surface of the second core portion 33 from coming into contact with any one of the inner circumferential surface of the bobbin, the inner circumferential surface of the yoke member 51, and the inner circumferential surface of the resin molded body 57, an appropriate gap is defined therebetween. It is desirable that such a gap be designed to have such a size as to prevent any of the contacts even if the connector unit 380 oscillates in sympathetic vibration with the engine. In addition, the gap prevents the outer circumference of the second core portion 36 from coming into pressure contact with the inner circumferential surface of the connector unit 380 during the assembly of the connector unit 380 to the valve seat unit 370. In short, the gap is adapted to prevent the connector unit from undergoing an excessive force during the assembly to be otherwise damaged.

However, to reduce the magnetic resistance of the magnetic path, it is advantageous that the gap is as small as possible at a portion between the outer circumferential surface of the second core 36 and an inner circumferential surface 51F of the hole provided on the bottom wall 51D of the cup-like yoke portion 51 to receive the second core inserted thereinto.

In order to make it easy for the second core member 36 to be inserted into the connector unit 380, it is preferable that the gap associated with the resin bobbin 52 be large in some degree.

Accordingly, the gaps are set in view of such conditions. Specifically, the gap associated with the bobbin 52 has the largest size (L1). The gap associated with the bottom wall 51D of the cup-like yoke member 51 has the smallest size (L2). The gap associated with the resin molded portion has the same size as that associated with the bottom wall 51D of the cup-like yoke member 51 or has the size slightly larger than that L1 associated with the bobbin 52.

In the present embodiment, the weld joined portion 55 connected electrically with the winding-start portion or winding-end portion of the lead line 54 forming the electromagnetic coil 53 is disposed external of the yoke member 51. The thickness of the bottom wall 51D of the cup-like yoke member 51 is reduced accordingly. Consequently, the bottom wall 51D of the cup-like yoke member 51 is reduced in thickness to reduce an area (flux-passing area) opposite the second core portion 36 in its thickness-direction. To compensate for the reduced area in the embodiment, a flange portion 52B of the bobbin 52 on the side opposite the first core portion 31 is reduced in thickness. With such a configuration, an end face 35F of the anchor 35 on the side opposite the first core portion 31 passes the end face K1, close to the bobbin, of the bottom wall 51D of the cup-like yoke member 51 so as to overlap the bottom wall 51D in its thickness direction.

Further, the cup-like portion of the second core member 36 is configured to pass through the hole provided in the bottom wall 51D of the cup-like yoke member 51 so as to project outward of the bottom wall 51D of the cup-like yoke member 51.

In this way, the magnetic flux passing through the bottom wall 51D of the cup-like yoke member 51 passes through the small gap and is led to the anchor 35 via the second core 36.

According to this configuration, (1) the inner circumferential surface 51F of the hole of the bottom wall 51D included in the cup-like yoke member 51 faces the outer circumferential surface of the second core 36 via the small gap; therefore, magnetic resistance can be reduced.

(2) The distance between the end face 35F of the anchor 35 and the inner circumferential surface 51F of the hole of the bottom wall 51D included in the cup-like yoke portion 51 is reduced; therefore, magnetic resistance can be reduced.

Thus, the overall magnetic path can be shortened to reduce the magnetic resistance.

The pump housing 1 is centrally formed with the protruding portion 1A as the pressurizing chamber 11. A recess 11A is formed to pass through the circumferential wall of the pressurizing chamber 11 so as to receive the discharge valve unit 8 mounted therein.

The discharge valve unit 8 is disposed at the outlet of the pressurizing chamber 11. The discharge valve unit 8 includes a seat member (a valve seat) 8*a*, a discharge valve 8*b*, a discharge valve spring 8*c*, and a holding member 8*d* as a discharge valve stopper. On the outside of the pump housing 1, a welded portion 8*e* is welded to assemble the discharge valve unit 8. Thereafter, the discharge valve unit 8 assembled from the left side in the figure is fixedly press-fitted into the pump housing 1. A press-fitting portion also has a function of isolating the pressurizing chamber 11 from the discharge port 12.

When there is no difference in the fuel pressure between the pressurizing chamber 11 and the discharge port 12, the discharge valve 8*b* is brought into pressure contact with the seat member 8*a* by the biasing force of the discharge valve spring 8*c*, leading to the closed state. When the fuel pressure in the pressurizing chamber 11 becomes higher than that in the discharge port 12 by a given value, the discharge valve 8*b* is first opened against the discharge valve spring 8*c* so that the fuel in the pressurizing chamber 11 is discharged toward the common rail 23 through the discharge port 12.

When the discharge valve 8*b* is opened, the valve 8*b* comes into contact with the holding member 8*d* to limit its movement. Therefore, the stroke of the discharge valve 8*b* is appropriately determined by the holding member 8*d*. If the stroke is too great, the closing-delay of the discharge valve 8*b* allows the fuel discharged to the fuel discharge port 12 to flow back again into the pressurizing chamber 11. This lowers efficiency as a high-pressure pump. While the discharge valve 8*b* repeats opening and closing movements, the discharge valve 8*b* is guided by the holding member 8*d* to move only in the stroke direction. With the configuration as described above, the discharge valve unit 8 serves as a check valve which limits the fuel flowing direction.

The cylinder 6 is held at the outer circumference by a cylindrical fitting portion 7*a* of a cylinder holder 7. The cylinder 6 is secured to the pump housing 1 by screwing a screw 7*g* that is threaded on the outer circumference of the cylinder holder 7 into a thread 1*b* that is made on the pump housing 1.

A plunger seal 13 is held at the lower end of the cylinder holder 7 by a seal holder 15 and the cylinder holder 7, the seal holder 15 being fixedly press-fitted to an inner cylindrical surface portion 7*c* of the cylinder holder 7. In this case, the plunger seal 13 is held by the inner cylindrical surface portion 7*c* of the cylinder holder 7 coaxially with the cylindrical fitting portion 7*a*. The piston plunger 2 and the plunger seal 13 are installed in slidable contact with each other at the lower end of the cylinder 6 in the figures.

This prevents the fuel in a seal chamber 10*f* from flowing toward a tappet 3, i.e., into the inside of the engine. Concurrently, this prevents lubricating oil (including engine oil) lubricating the sliding portions in an engine room from flowing into the inside of the pump housing 1.

The cylinder holder 7 is provided with an outer cylindrical surface portion 7*b* on which a groove 7*d* adapted to receive an O-ring 61 fitted thereinto is formed. The O-ring 61 is such that the inner wall of a fitting hole 70 on the engine side and the groove 7*d* of the cylinder holder 7 isolate the cam side of the engine from the outside, thereby preventing engine oil from leaking outward.

The cylinder 6 has a pressure contact portion 6*a* intersecting the reciprocating direction of the piston plunger 2. The pressure contact portion 6*a* is in pressure contact with a pressure contact surface 1*a* of the pump housing 1. The pressure contact is executed by a thrust force resulting from screw-fastening. The pressure chamber 11 is formed by the pressure contact mentioned above. Screw-fastening torque must be controlled so that even if being highly pressurized, the fuel in the pressurizing chamber 11 will never leak out of that via the pressure contact portion.

To keep the sliding length between the piston plunger 2 and the cylinder 6 appropriate, the cylinder 6 is deeply inserted into the pressurizing chamber 11. On the side of the pressurizing chamber 11 with respect to the pressure contact portion 6*a* of the cylinder 6, a clearance 1B is provided between the outer circumference of the cylinder 6 and the inner circumference of the pump housing 1. The cylinder 6 is held at the outer circumference by the cylindrical fitting portion 7*a* of the cylinder holder 7. Therefore, the provision of the clearance 1B can eliminate the contact between the outer circumference of the cylinder 6 and the inner circumference of the pump housing 1.

In the manner as described above, the cylinder 6 can hold the piston plunger 2 advancing and retreating in the pressurizing chamber 11, slidably in the advancing and retreating direction.

The tappet 3 is provided at the lower end of the piston plunger 2. The tappet 3 is adapted to convert the rotation movement of a cam 5 attached to a camshaft of the engine into up-and-down movement and transmit the movement to the piston plunger 2. The plunger piston 2 is press fitted to the tappet 3 via a retainer 16 by means of a spring 4. The retainer 16 is fixedly press fitted to the piston plunger 2. In this way, the piston plunger 2 can be advanced and retreated (reciprocated) up and down along with the rotation movement of the cam 5.

The piston plunger 2 repeats the reciprocating movement inside the cylinder 6. In this case, if the inner circumference of the cylinder 6 is deformed, the piston plunger 2 and the cylinder 6 may seize and fix with each other. If so, the piston plunger 2 cannot perform the reciprocating movement so that it cannot discharge fuel at high pressure.

It is conceivable that one of the causes of the fixation may be deformation of the inner circumferential portion (sliding portion) of the cylinder 6. In a case in which the coaxiality between the outer cylindrical surface portion 7*b* and the cylindrical fitting portion 7*a* may be very low, the inner wall of the fitting hole 70 on the engine side and the outer cylindrical surface portion 7*b* come into contact with each other. Thus, the installation of the pump will cause a minute deformation of the cylinder 6.

To solve such a problem, in the present embodiment, the outer surface portion 7*b* and the cylindrical fitting portion 7*a* are provided on the cylinder holder 7. If the outer cylindrical surface portion 7*b* and the cylindrical fitting portion 7*a* are made of different members each other, causes of degrading the coaxiality will inevitably occur at machined and joined portions. However, such a problem can be solved by forming the outer cylindrical surface portion 7*c* and the cylindrical fitting portion 7*a* in one and the same member.

In the present embodiment, the cylinder 6 is formed to project toward the pressurizing chamber 11 from the pressure contact portion 6*a* thereof. In addition, the clearance 1B is defined between the outer circumference of the cylinder 6 and the inner circumference of the pump housing 1. The pressure contact surface between the cylinder 6 and the pump housing 1 extends in a direction intersecting the direction of the reciprocating movement of the piston plunger 2 and is disposed external of the clearance 1*b*.

The cylinder 6 and the pump housing 1 are configured such that even if they are brought into pressure contact with each other, the deformation of the pressure contact portion is hard to be transmitted to the inner circumference of the cylinder 6. In this way, while the deformation of the inner circumference of the cylinder 6 is minimized, the sliding length between the cylinder 6 and the piston plunger 2 can be made long.

The other causes of the fixation include the inclination of the piston plunger 2. This may probably occur if the coaxiality between the axis of the sliding portion between the cylinder 6 and the piston plunger 2 and the axis of the sliding portion between the plunger seal 13 and the piston plunger 2.

To solve such a problem, in the present embodiment, the cylindrical fitting portion 7*a* and the inner cylindrical surface portion 7*c* are provided on the cylinder holder 7. If the cylindrical fitting portion 7*a* and the inner cylindrical surface portion 7*c* are made of different members each other, causes of degrading the coaxiality will inevitably occur at machined and joined portions. However, such a problem can be solved by forming the cylindrical fitting portion 7*a* and the inner cylindrical surface portion 7*c* in one and the same member.

For the reason described above, the cylindrical fitting portion 7*a*, the outer cylindrical surface portion 7*b* and the inner cylindrical surface portion 7*c* are all configured to be provided on the cylinder holder 7. This configuration can concurrently solve the problem of the coaxiality between the outer cylindrical surface portion 7*b* and the cylindrical fitting portion 7*a* and between the cylindrical fitting portion 7*a* and the inner cylindrical surface portion 7*c*. Further, as a result, the deformation of the inner circumferential portion (the sliding portion) of the cylinder 6 and the inclination of the piston plunger can concurrently be solved.

The intake passage 10*c* is connected to a seal chamber 10*f* through an intake passage 10*d* and through an intake passage 10*e* provided in the cylinder holder 7. The seal chamber 10*f* constantly undergoes the pressure of intake fuel. When the fuel in the pressurizing chamber 11 is highly pressurized, a small amount of high-pressure fuel flows into the seal chamber 10*f* through the slide clearance between the cylinder 6 and the piston plunger 2. However, since the high-pressure fuel that has flowed thereinto is released into intake pressure, the plunger seal 13 will not be damaged due to high pressure.

The piston plunger 2 is composed of a large-diameter portion 2*a* sliding along the cylinder 6 and a small-diameter portion 2*b* sliding along the plunger seal 13. The large-diameter portion 2*a* has a diameter greater than that of the small-diameter portion 2*b*. In addition, the large-diameter portion 2*a* and the small-diameter portion 2*b* are designed coaxially with each other. The sliding portion with the cylinder 6 is the large-diameter portion 2*a* and the sliding portion with the plunger seal 13 is the small-diameter portion 2*b*. Since a joint portion between the large-diameter portion 2*a* and the small-diameter portion 2*b* is located in the seal chamber 10*f*, the capacity of the seal chamber 10*f* is varied along with the sliding movement of the piston plunger 2. Along with the variations, fuel is moved between the seal chamber 10*f* and the intake passage 10*c* through the intake passages 10*d*, 10*s*.

Since the piston plunger 2 repeatedly slides along the plunger seal 13 and the cylinder 6, it generates friction heat. Because of the friction heat, the large-diameter portion 2*a* of the piston plunger 2 is thermally expanded. A portion of the large-diameter portion 2*a*, which is closer to the plunger seal 13 is closer to a heat-generating source than another portion of the larger diameter portion 2*a*, which is closer to the pressurizing chamber 11. Therefore, the thermal expansion of the large-diameter portion 2*a* will not be uniform and consequently the large-diameter portion 2*a* lowers in cylindrical degree. Thus, the plunger 2 and the cylinder 6 will seize and fix with each other.

In the present embodiment, the sliding movement of the piston plunger 2 constantly changes the fuel in the seal chamber 10*f*. This fuel has an effect of removing the heat generated. This effect can prevent the deformation of the large-diameter portion 2*a* due to the friction heat so as to prevent the seizure and fixation between the piston plunger 2 and the cylinder 6 that occur due to the deformation.

Further, the smaller the diameter of the sliding portion with the plunger seal 13, the more reduced the friction area. Therefore, also the friction heat generated by the sliding movement is reduced. In the present embodiment, it is the small-diameter portion 2*b* of the piston plunger 2 that slides along the plunger seal 13. Therefore, the amount of heat generated by the friction with the plunger seal 13 can be suppressed to a low level to prevent the seizure and fixation.

Figure 8:
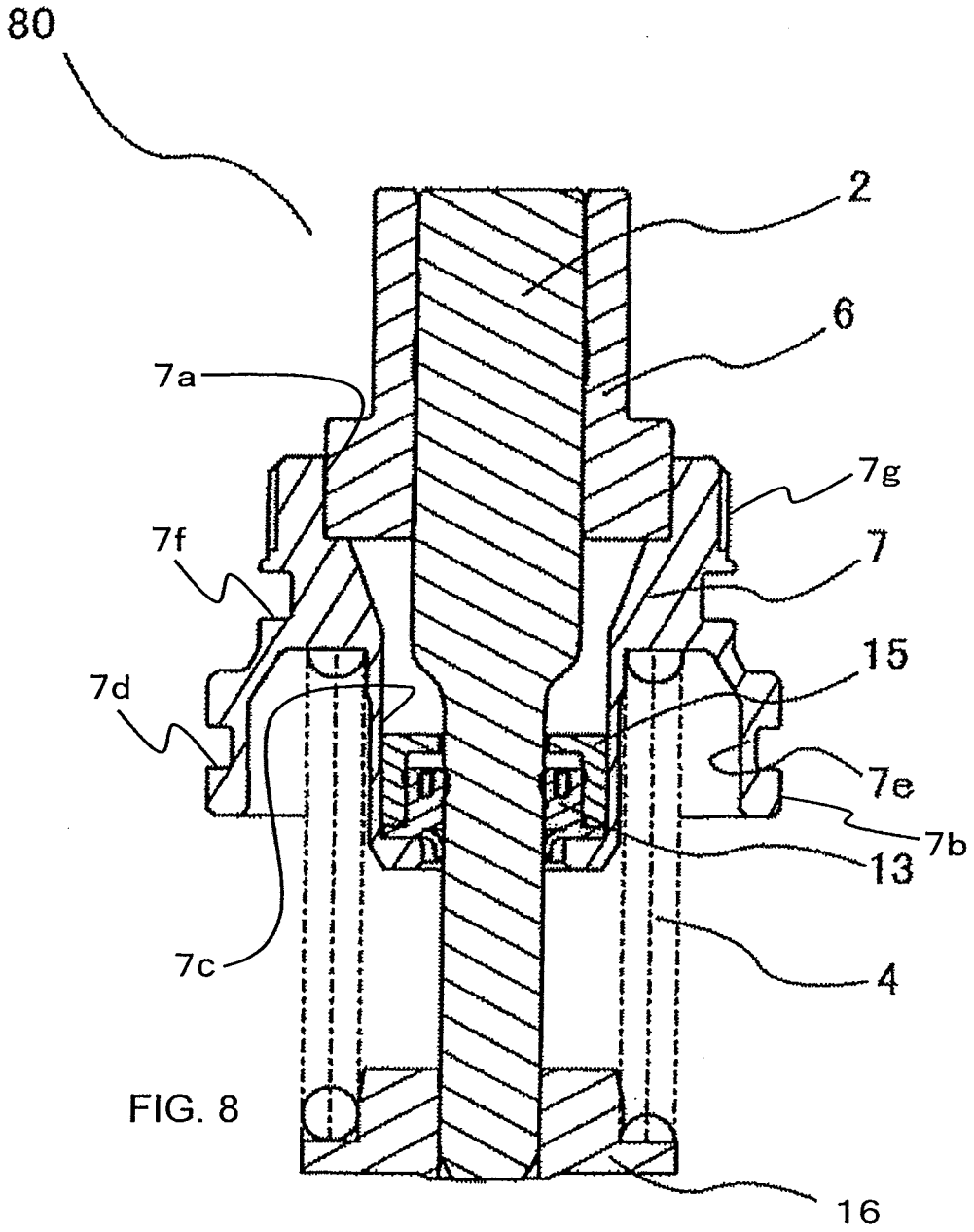
FIG. 8 illustrates a state before a piston plunger unit of the high-pressure fuel pump according to the first embodiment of the invention is assembled into the pump housing.

FIG. 8 illustrates a state before the cylinder holder 7 is secured to the pump housing 1 by means of screws.

The piston plunger 2, the cylinder 6, the seal holder 15, the plunger seal 13, the cylinder holder 7, the spring 4 and the retainer 16 constitute a plunger unit 80.

Figure 9:
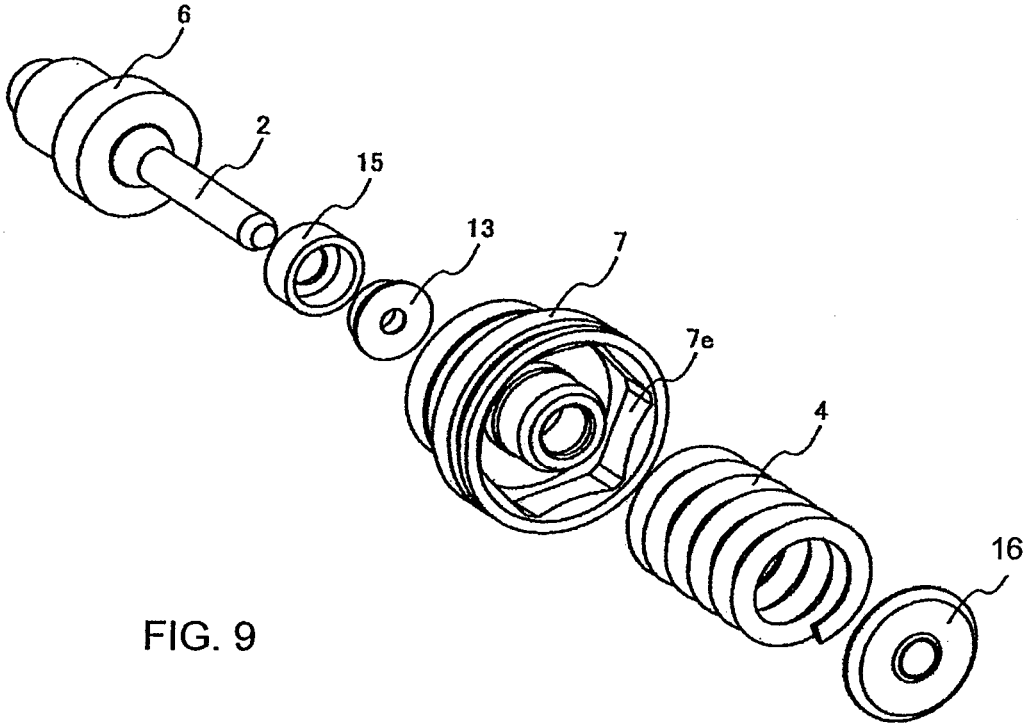
FIG. 9 illustrates a method of assembling the piston plunger unit of the high-pressure fuel pump according to the first embodiment of the invention.

FIG. 9 illustrates a method of assembling the plunger unit 80.

The piston plunger 2, the cylinder 6, the seal holder 15, and the plunger seal 13 are first assembled into the cylinder holder 7 from the upper left in the figure. In this case, the seal holder 15 is fixedly press-fitted into the inner cylindrical surface portion 7*c* of the cylinder holder 7 as described above. Thereafter, the spring 4 and retainer 16 are assembled from the lower right in the figure. In this case, the retainer 16 is fixedly press-fitted into the piston plunger 2.

After the O-ring 61 and an O-ring 62 are attached to the plunger unit 80, they are fixedly fastened to the pump housing 1 by means of the screws as described above. The fastening is performed by use of a hexagonal portion 7*e* formed on the cylinder holder 7. The hexagonal portion 7*e* is shaped internally-hexagonally. A screw is fastened by torque generated by use of a specialized tool. By controlling the torque, a surface pressure between the pressure contact portion 6*a* and the pressure contact surface 1*a* is controlled. Incidentally, an O-ring 62 is attached to the outer circumferential groove 7*f* of the cylinder 7.

The metal diaphragm damper 9 is composed of two metal diaphragms. The metal diaphragms are secured to each other in full-circumferentially by welding their welded portions in the state where gas is sealed in a space between the metal diaphragms. The metal diaphragm dumper 9 has a mechanism as below. When low-pressure pulsations are applied to both the surfaces of the dumper 9, the dumper 9 varies in capacity to thereby reduce the low-pressure pulsations.

The high-pressure fuel pump is secured to the engine by means of a flange 41, setscrews 42 and bushes 43. The flange 41 is full-circumferentially welded and joined to the pump housing 1 at a welded portion 41*a*. The present embodiment uses laser welding.

Figure 10:
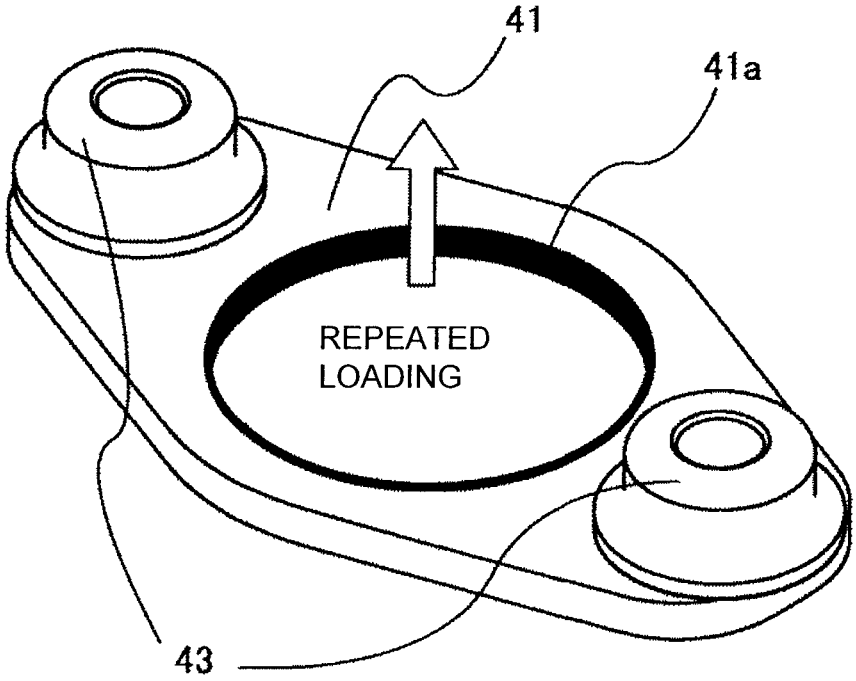
FIG. 10 illustrates an external view of a flange and bushes of the high-pressure fuel pump according to the first embodiment of the invention, illustrating only the flange and the bushes except the other parts.

FIG. 10 is a perspective view of the flange 41 and bushes 43. This figure illustrates only the flange 41 and the bushes 43 and omits the other parts.

The two bushes 43 are attached to the flange 41 on a side opposite the engine. The two setscrews 42 are screwed to respective threads formed on the engine side. The high-pressure fuel pump is secured to the engine by pressing the two bushes 43 and flange 41 to the engine.

Figure 11:
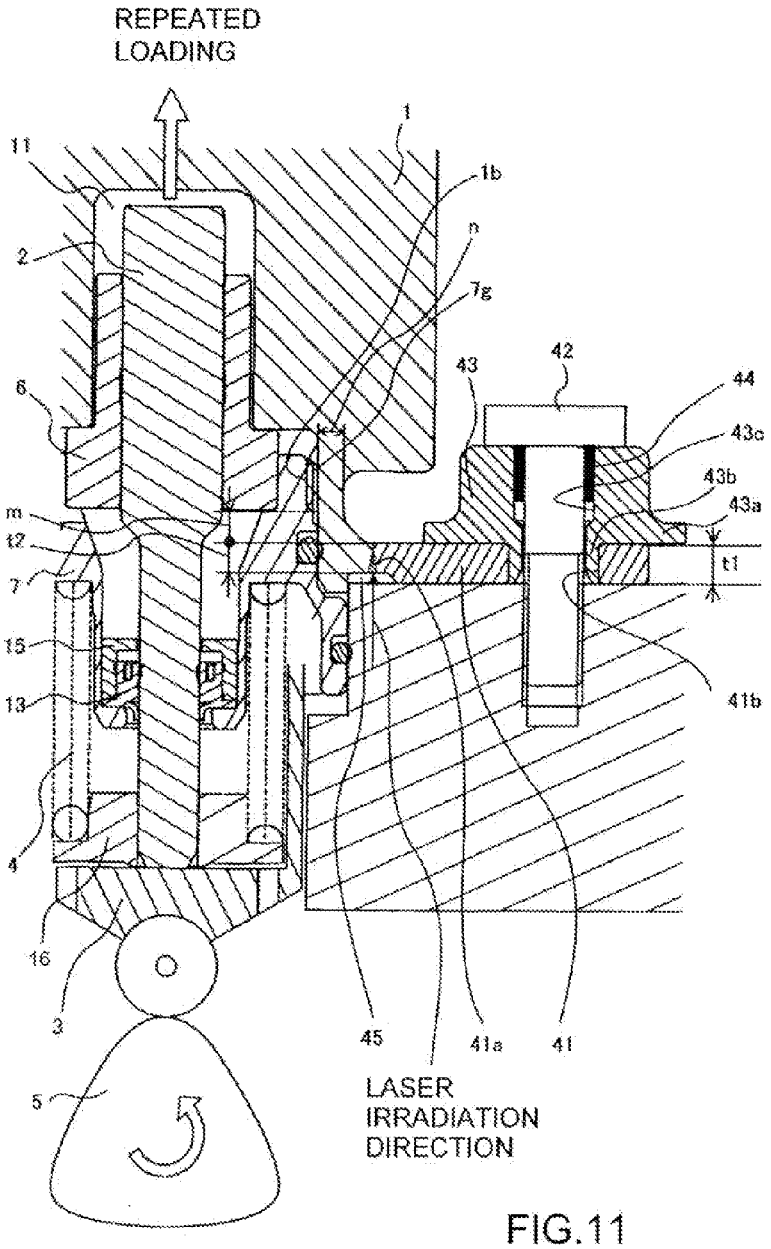
FIG. 11 illustrates an enlarged view illustrating the vicinity of a welded portion between a mounting flange and pump main body of the high-pressure fuel pump according to the first embodiment of the invention.

FIG. 11 is an enlarged view illustrating a portion associated with the flange 41, setscrew 42 and bush 43.

The bush 43 has a flange portion 43*a* and a caulking portion 43*b*. First, the caulking portion 43*b* is caulked and fitted into an attachment hole of the flange 41. Then, the pump housing 1 and a welded portion 41*a* are joined together by laser welding. Thereafter, a resin fastener 44 is inserted into the bush 43 and further the setscrew 42 is inserted into the fastener 44. The fastener 44 plays a role of temporarily fixing the setscrew 42 to the bush 43. In other words, before the high-pressure fuel pump is mounted to the engine, the fastener 44 fixes the setscrew 42 to prevent it from falling off from the bush 43. When the high-pressure fuel pump is secured to the engine, the setscrew 42 is fixedly screwed to the thread portion provided on the engine side. In this case, the setscrew 42 can be turned in the bush 43 by the fastening torque of the setscrew 42.

While the high-pressure fuel pump repeats high-pressure discharge, the pressurizing chamber 11 repeatedly undergoes high pressure and low pressure therein as described above. When the pressurizing chamber 11 has high pressure therein, the pump housing 1 undergoes the force resulting from the high pressure so as to be lifted upward in the figures. On the other hand, when the pressurizing chamber 11 has low pressure therein, the pump housing 1 does not undergo such a force. Because of this, the pump housing will undergo repeated loading upward in the figures.

As illustrated in FIG. 10, the flange 41 serves to secure the pump housing 1 to the engine by means of the two setscrews 42. Consequently, when the pump housing 1 is lifted upward as described above, the flange 42 undergoes repeated bending loads at the central portion with portions corresponding to the two setscrews 42 and to the bushes 43 secured. The repeated bending loads deform the flange 41 and the pump housing 1 to cause repeated stress therein, which leads to a problem of fatigue breakdown. Further, also the cylinder holder 7 and the cylinder 6 are deformed; therefore, also the sliding portion of the cylinder 6 is deformed so that the seizure and fixation between the piston plunger 2 and the cylinder 6 occur as described above.

The flange 41 is manufactured by press forming for the reason of productivity. The thickness t1 of the flange 41 has an upper limit; t1=4 mm in the embodiment. A welded portion 41 or a joined portion between pump housing 1 and the flange 42 is joined together by laser welding. The laser welding needs a laser beam emitted from the downside in the figure. It is impossible to emit a laser beam from the upside to the full circumference because other component parts are present thereabove. Further, the laser welding has to penetrate the flange 41 with a thickness t of 4 mm. If the laser welding does not penetrate it, the end face of the welded portion becomes notched. The stress resulting from the repeated loads mentioned above concentrates on the notched portion, which leads to fatigue breakdown.

To penetration-weld the flange 41 by laser welding, increasing the output power of laser may be required. However, welding inevitably generates heat, which thermally deforms the flange 41. In addition, during welding, spatters occur in large amounts and adhere to the pump housing 1 and other component parts. In view of the foregoing, the short length of penetration-welding by laser welding is preferable.

Therefore, only the thickness t2 of the welded portion 41*a* is 3 mm in the present embodiment. This makes it possible to penetration-weld the flange 41*a* by laser welding, whereby the occurrence of spatters can be minimized. In addition, a portion with a thickness t2 of 3 mm can be formed by press forming, which yields high productivity.

A stepped portion between the portion with a thickness t2 of 3 mm in the welded portion 41*a* and the portion with a thickness t1 of 4 mm is provided on the engine side. Thus, a void 45 is formed. The upper end face and lower end face of the welded portion 41*a* inevitably protrude from a base material. The provision of the void 45 can prevent the protrusion and the engine from interfering with each other. If the protrusion and the engine are in contact with each other, when the high-pressure fuel pump is secured to the engine by means of the setscrews 42, the flange 41 causes bending stress, leading to breakage.

The provision of the void 45 can prevent the flange 41 from being damaged due to the repeated loading resulting from the high-pressure discharge. In addition, the provision of the void 45 can prevent the flange 41 from being damaged, which is due to contact between the protrusion of the welded portion 41*a* and the engine.

As described above, if the pump housing 1 undergoes repeated loading, it bents in the direction of the repeated loading with the portions corresponding to the two setscrews 42 and to the bushes 43 secured. Since the welded portion 41*a* is penetration-welded along the full circumference by laser welding, the bending of the flange 41 affects the pump housing 1. On the other hand, the cylinder holder 7 and the pump housing 1 are in contact with each other at portions corresponding to the screw 7*g* and to the thread 1*b*. The thread 1*b* of the pump housing 1 and the welded portion 41*a* are located at respective positions spaced a distance m apart from each other. The pump housing 1 has a minimum thickness of n at a position corresponding to the distance m from the welded portion 41*a*. The values of m and n are selected so that even if the pump housing 1 is deformed by the bending of the flange 41, the portions corresponding to the distance m and thickness n accommodate the deformation so as not to affect up to the thread 1*b*.

This can prevent the deformation of the cylinder 6 due to the bending of the flange 41. However, the pump housing 1 has to accommodate all the bending of the flange 41. In the event that the repeated stress caused in the pump housing 1 exceeds an allowable value, the pump housing 1 is subjected to fatigue breakdown, leading to fuel leakage trouble.

There are two methods as below in order to prevent the fatigue breakdown of the pump housing 1 as mentioned above.

(1) To make the stress thus generated below an allowable value by the shaping effect of the pump housing 1.

(2) To reduce the bending occurring in the flange 41.

A description is below given of the two methods.

Figure 12:
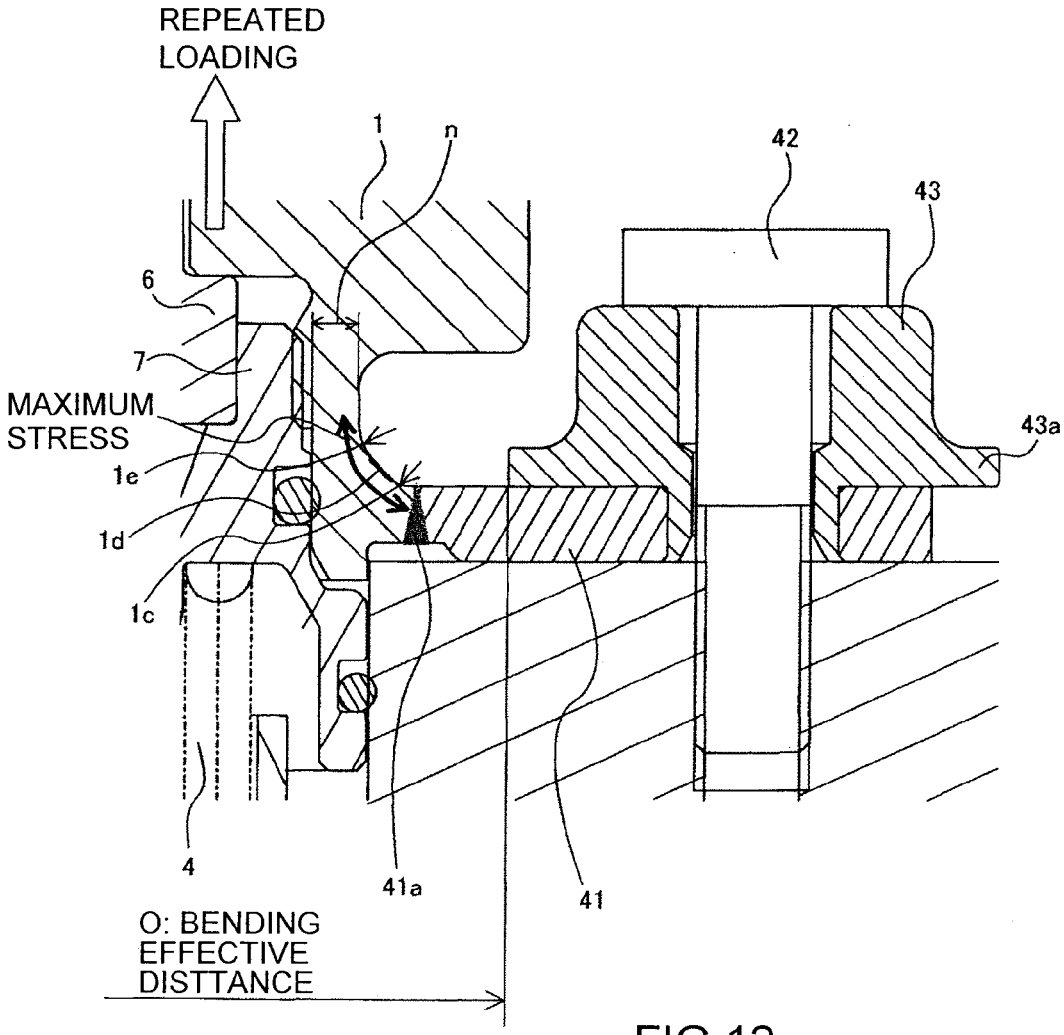
FIG. 12 is an enlarged view illustrating the vicinity of a welded portion between a mounting flange and pump main body of the high-pressure fuel pump according to the first embodiment of the invention, namely, a further enlarged view of FIG. 11.

The method (1) is first described. FIG. 12 is an enlarged view illustrating the vicinity of the welded portion 41*a*. The pump housing 1 is pulled upward in the figure by the repeated loading to bend the flange 41, causing stress. Its maximum stress occurs in the front surface of the pump housing 1 in arrow directions as depicted as "maximum stress" in FIG. 11. The pump housing 1 may be shaped so that the occurring stress may be dispersed as much as possible by the shaping effect so as not to cause stress concentration.

The present embodiment provides a structure where an R-portion 1*c* and an R-portion 1*e* are connected to each other through a straight portion 1*d* as shown in the figure. In addition, the R-portions 1*c*, 1*e* and the straight portion 1*d* are designed to select respective optimum values. The straight portion 1*d* lies between the two R-portions c and 1*e* and stress occurring on the straight portion 1*d* is distributed uniformly. As a result, stress concentration does not occur so that the maximum value of the occurring stress can be reduced.

A description is next given of the method (2). There is only a method to increase the rigidity of the flange 41 in order to reduce the bending of the flange 41. However, it is very difficult for the flange 41 to have a thickness t of 4 mm or more in view of productivity as described above. For this reason, the diameter of the bush 43 that is provided only to secure the setscrew 42 is increased. A bending effective distance "O" indicates a shortest distance between the ends of the two bushes 43. A portion between the ends of the two bushes 43 is substantially bent by the repeated loading. If the bending effective distance "O" can be reduced, the rigidity of the flange 41 can be enhanced as a consequence.

In the present embodiment, the flange portion 43*a* is provided on the bush 43 in order to reduce the bending effective distance "O". The bush 43 needs such a height as to receive the fastener 44 inserted therethrough. If the height increases the external shape of the bush 43, there are problems of interference with the pump housing 1, of the increase of the material of the bush 43, etc. The provision of the flange portion 43*a* can prevent such problems and reduce the bending effective distance "O".

The configurations as described above can achieve the methods (1) and (2) and make the repeated stress occurring in the pump housing 1 lower than the allowable value of fatigue breakdown.

The problem that has solved by the embodiment and the modes for solving the problem are summarized as below.

In the conventional electromagnetically-driven valve mechanism described in JP-A-8-105566, the valve seat (52) member and the bearing member (bearing 98) of the movable plunger (valve stem 92) attached with the valve member (94) at the distal end are composed of different members each other, which are integrally assembled into one unit.

With such a configuration, however, the degree of close contact between the valve seat member and the valve member is insufficient to cause the leakage of fluid. This poses a problem in that accurate flow control cannot be exercised.

The present embodiment can reduce the leakage of fluid from the seat portion of the electromagnetically-driven valve mechanism used in e.g. the variable capacity control mechanism of the high-pressure fuel pump.

In the present embodiment, the valve seat member and the valve member are configured in a single piece resulting from machining one and the same member.

With such a configuration, the gap between the movable plunger and the bearing can be made smaller than ever before. Consequently, the inclination of the movable plunger can be suppressed, sealing performance between the valve seat member and the valve member can be enhanced and thus fluid control accuracy can be improved.

Specific modes for carrying out the invention are as below.

[Mode 1]

An electromagnetically-driven valve mechanism including: an externally-open type valve member disposed at a fluid inlet port; a movable plunger operated by an electromagnetic force; a holder securing the cylinder to the pump housing; a restricting member restricting the displacement of the plunger at a specific position; a spring member biasing the movable plunger on the side opposite the restricting member; an electromagnetic drive mechanism for electromagnetically biasing the movable plunger to bias the valve member and the movable plunger in the direction of closing the fluid inlet port; a valve seat with and from which the valve member comes into close contact and moves away; and a bearing member supporting the movable plunger in a reciprocatable manner; wherein the valve seat and the bearing member are made of a single piece resulting from machining one and the same member.

[Mode 2]

The electrically-driven valve mechanism recited in mode 1, wherein an anchor is secured to an end of the movable plunger on the side opposite the valve member, the anchor is disposed to face the restricting member through a magnetic gap, the restricting member constitutes a magnetic core portion of the electromagnetic drive mechanism, a cap member made of a magnetic material is secured to the magnetic core portion of the restricting member to surround the anchor and the magnetic gap and seal the inside thereof, an electromagnetic coil is attached to the outer circumference of the cap member made of the magnetic material, and a yoke portion is disposed on the outer circumference of the electromagnetic coil to form a magnetic path in cooperation with the anchor, the magnetic gap, the magnetic core portion and the cap member.

[Mode 3]

The electrically-driven valve mechanism recited in mode 1, wherein the electromagnetic drive mechanism has a body portion made of a magnetic material, and the bearing member is fixedly press fitted into the inner circumferential wall of the internal through-hole formed in the body portion of the electromagnetic drive mechanism.

[Mode 4]

The electrically-driven valve mechanism recited in mode 1, wherein an anchor is secured to an end of the movable plunger on the side opposite the valve member, the anchor is disposed to face the restricting member through a magnetic gap, the restricting member constitutes a magnetic core portion of the electromagnetic drive mechanism, a cap member made of magnetic material is secured to a magnetic core portion of the restricting member to surround the anchor and the magnetic gap and seal the inside thereof, an electromagnetic coil is attached to the outer circumference of the cap member, a yoke member is disposed on the outer circumference of the electromagnetic coil so as to form a magnetic path in cooperation with the anchor, the magnetic gap, the magnetic core portion and the cap member, the magnetic drive mechanism has a body portion made of a magnetic material, and the bearing member is fixedly secured to the inner circumferential wall of an inner through-hole formed in the body portion of the electromagnetic drive mechanism.

[Mode 5]

The electrically-driven valve mechanism recited in mode 2 or 4, wherein a coil spring as the spring member is installed between the inner circumferential portion of the anchor and the outer circumference of the movable plunger.

[Mode 6]

The electrically-driven valve mechanism recited in mode 2, 4 or 5, wherein in a state where the anchor is attached, the movable plunger and the valve member formed integrally with each other have an axial gravity center disposed at a position closer to the anchor than to an axially central portion of the bearing member.

[Mode 7]

The electrically-driven valve mechanism recited in mode 2 or 4, wherein the electrically-driven valve mechanism includes a resin molded body portion surrounding at least part of the outer circumference of the yoke portion, and the resin molded body portion is integrally provided with a connector and a joined portion between a terminal of the connector, and a terminal of the electromagnetic coil is formed external of the yoke portion.

[Mode 8]

The electrically-driven valve mechanism recited in mode 1, wherein force other than the electromagnetic force is designed to assist the movement of the movable plunger in the same direction as the movement of the movable plunger by the electromagnetic force, and after a specific displacement of the movable plunger in a direction of the restricting member by the force other than the electromagnetic force, the electromagnetic force is applied to the movable plunger.

[Mode 9]

The electrically-driven valve mechanism recited in mode 1, wherein after the valve member has initially operatively been opened against the force of the spring member due to a fluid differential pressure between the upstream side and downstream side of the valve member, the electromagnetic drive mechanism biases the movable plunger in a direction of maintaining or assisting the opening-directional operation of the valve member.

[Mode 10]

A high-pressure fuel pump having an inlet valve composed of the electromagnetically-driven valve mechanism recited in any one of modes 1 to 7.

[Mode 11]

The high-pressure fuel pump recited in mode 10, wherein in a state where the electromagnetic drive mechanism is not energized and the fluid differential pressure does not exist, the inlet valve member is closed by the spring member.

[Mode 12]

The high-pressure fuel pump recited in mode 10, wherein the inlet valve member is operatively opened or is maintained in an opened state by applying input voltage to the electromagnetic drive mechanism in an intake process of the piston plunger constituting part of the high-pressure fuel pump.

[Mode 13]

The high-pressure fuel pump recited in mode 10, 11 or 12, wherein after the inlet valve member has operatively been opened against a biasing force of the spring member due to a fluid differential pressure between an intake path side and a pressurizing chamber side of the inlet valve member, the opening operation of the inlet valve member is maintained or assisted by applying input voltage to the electromagnetic drive mechanism.

[Mode 14]

The high-pressure fuel pump recited in mode 10, wherein after the opening state has been maintained with input voltage remaining applied to the electromagnetic drive mechanism, the input voltage is turned off in a compression process of the piston plunger to turn off an electric current flowing to the electromagnetic drive mechanism.

[Mode 15]

The high-pressure fuel pump recited in mode 10, wherein timing to turn off the input voltage applied to the electromagnetic drive mechanism is controlled according to movement of the piston plunger to control a flow rate of fuel discharged at high pressure.

[Mode 16]

The high-pressure fuel pump recited in mode 10, wherein a value of electric current occurring in the electromagnetic drive mechanism is controlled by varying input voltage.

[Mode 17]

The high-pressure fuel pump recited in mode 10, wherein during a time period from application of input voltage to the electromagnetic drive mechanism to the cancel of the application, the application of the input voltage and the cancel of the application are periodically repeated in further shorter periods.

[Mode 18]

The high-pressure fuel pump recited in mode 10, wherein the electromagnetic inlet valve is assembled as a unit.

INDUSTRIAL APPLICABILITY

The assembly mechanism of the present invention is useful as a mechanism for assembling the high-pressure fuel pump into the engine block.

EXPLANATION OF REFERENCE NUMERALS

1 Pump housing
2 Piston plunger
5 Cam
6 Cylinder
7 Cylinder holder
**7*a*** Cylindrical fitting portion
**7*b*** Outer cylindrical surface portion
**7*c*** Inner cylindrical surface portion
8 Discharge valve unit
9 Metal diaphragm damper
11 Pressurizing chamber
12 Discharge port
13 Plunger seal
61, 62 O-ring
100 Engine block

The invention claimed is:

1. A high-pressure fuel pump comprising:

a pump housing having an inner surface and an outer surface;

a cylinder that together with the pump housing defines a pressurizing chamber;

a holder that holds the cylinder; and a plunger sliding against the cylinder to pressurize fluid in the pressurizing chamber; wherein the holder includes an outer cylindrical surface portion fitted to an attachment fitting hole of an engine block of an internal combustion engine, the holder is provided with an inner cylindrical surface portion that is adjacent to an outer circumference of the cylinder, the outer cylindrical surface portion and the inner cylindrical surface portion are formed in a single piece resulting from machining one and the same member, the holder has a seal member which contacts the engine block only at a diametrical surface of the engine block, the holder however does not contact the engine block at an axial surface of the engine block, the diametrical surface of the engine block extends along a direction that is more similar to a direction of a longitudinal axis of the plunger than to a direction that is perpendicular to the direction of the longitudinal axis of the plunger, and the axial surface of the engine block extends along a direction that is more similar to the direction that is perpendicular to the direction of the longitudinal axis of the plunger than to the direction of the longitudinal axis of the plunger, and the cylinder has a cylinder small-diameter portion axially projecting into the pressurizing chamber and radially facing an inner circumferential surface of the pump housing and a cylinder large-diameter portion that is: i) larger in diameter than the cylinder small-diameter portion, ii) the largest overall diameter of cylinder, and iii) closer to the engine block than the cylinder small-diameter portion.

2. The high-pressure fuel pump according to claim 1, wherein the seal member forming a seal portion in cooperation with an inner circumferential surface of the attachment fitting hole of the engine block is attached to the outer cylindrical surface portion of the holder.

3. The high-pressure fuel pump according to claim 1, further comprising:

a second seal member in slidable contact with an outer circumferential surface of the plunger, the outer circumferential surface being located on a side opposite the pressurizing chamber, wherein the second seal member is housed in a second inner cylindrical surface portion of the holder.

4. The high-pressure fuel pump according to claim 3, wherein the outer cylindrical surface portion, and the second inner cylindrical surface portion are formed in a single piece resulting from machining one and the same member.

5. The high-pressure fuel pump according to claim 3, wherein the outer cylindrical surface portion, and the second inner cylindrical surface portion are formed to have the same axial center.

6. The high-pressure fuel pump according to claim 1, wherein an adjusting gap is provided between the inner circumferential surface of the pump housing defining the pressurizing chamber and an outer circumferential surface of the cylinder small-diameter portion projecting into the pressurizing chamber, and the adjusting gap communicates with the pressurizing chamber.

7. The high-pressure fuel pump according to claim 1, wherein a seal structure is provided between a second outer circumferential surface of the holder and a second inner circumferential surface of the pump housing.

8. The high-pressure fuel pump according to claim 7, wherein the holder has a seal portion where the seal member is attached and a second seal portion where the seal structure is provided, the second seal portion of the holder arranging closer to the longitudinal axis of the plunger than the seal portion of the holder.

9. The high-pressure fuel pump according to claim 1, wherein the plunger is configured to advance into and retreat from the inside of the pressurizing chamber formed in the pump housing beyond the distal end of the cylinder.

10. The high-pressure fuel pump according to claim 1, wherein a metal contact seal portion is formed by bringing the pump housing and the cylinder into pressure contact with each other at a plane crossing the movement direction of the plunger, and a pressing mechanism that is formed by at least the holder, is provided, the pressing mechanism relatively pressing the pump housing and the cylinder toward the metal contact seal portion.

11. The high-pressure fuel pump according to claim 10, wherein the pressing mechanism is composed of a screw portion formed on an outer circumference of the holder and a second screw portion formed on the pump housing so as to be threadably engaged with the screw portion.

12. The high-pressure fuel pump according to claim 1, wherein the holder is connected to the pump housing and to the engine block of the internal combustion engine.

13. A high-pressure fuel pump comprising:

a pump housing having an inner surface and an outer surface;

a cylinder that together with the pump housing defines a pressurizing chamber; and a plunger sliding against the cylinder to pressurize fluid in the pressurizing chamber; wherein reciprocation of the plunger pressurizes fuel sucked into the pressurizing chamber and discharges the fuel from the pressurizing chamber, the high-pressure fuel pump includes:

a second seal member in slidable contact with an outer circumferential surface of the plunger, the outer circumferential surface being located on a side opposite the pressurizing chamber, and a holder including a second inner cylindrical surface portion, the holder includes an outer cylindrical surface portion fitted to an attachment fitting hole of an engine block of an internal combustion engine, and the second inner cylindrical surface portion housing the second seal member, the holder is provided with an inner cylindrical surface portion that is adjacent to an outer circumference of the cylinder, the outer cylindrical surface portion and the inner cylindrical surface portion are formed in a single piece resulting from machining one and the same member, and an outer circumferential surface of the cylinder and an inner circumferential surface of the pump housing are configured to form a gap, the holder has a seal member which contacts the engine block only at a diametrical surface of the engine block via the outer cylindrical surface portion, the holder however does not contact the engine block at an axial surface of the engine block, the diametrical surface of the engine block extends along a direction that is more similar to a direction of a longitudinal axis of the plunger than to a direction that is perpendicular to the direction of the longitudinal axis of the plunger, and the axial surface of the engine block extends along a direction that is more similar to the direction that is perpendicular to the direction of the longitudinal axis of the plunger than to the direction of the longitudinal axis of the plunger, and the cylinder has a cylinder small-diameter portion axially projecting into the pressurizing chamber and radially facing an inner circumferential surface of the pump housing and a cylinder large-diameter portion that is: i) larger in diameter than the cylinder small-diameter portion, ii) the largest overall diameter of cylinder, and iii) closer to the engine block than the cylinder small-diameter portion.

14. The high-pressure fuel pump according to claim 13, wherein the outer cylindrical surface portion, and the inner cylindrical surface portion are formed of respective cylindrical surfaces, axial centers of the cylindrical surfaces coinciding with a central axis of an insertion hole of the plunger formed in the cylinder.

15. A high-pressure fuel pump comprising:

a pump housing having an inner surface and an outer surface;

a cylinder combined with the pump housing to define a pressurizing chamber;

a plunger sliding against the cylinder to pressurize fluid in the pressurizing chamber; wherein reciprocation of the plunger pressurizes fuel sucked into the pressurizing chamber and discharges the fuel from the pressurizing chamber;

the high-pressure pump includes a second seal member in slidable contact with an outer circumferential surface of the plunger, the outer circumferential surface being located on a side opposite the pressurizing chamber; and a holder including an inner cylindrical surface portion and a second inner cylindrical surface portion, wherein the holder includes an outer cylindrical surface portion fitted to an attachment fitting hole of an engine block of an internal combustion engine, the second inner cylindrical surface portion housing the second seal member, the outer cylindrical surface portion and the inner cylindrical surface portion are formed of respective cylindrical surfaces, axial centers of the cylindrical surfaces coinciding with a central axis of an insertion hole of the plunger formed in the cylinder, at least the outer cylindrical surface portion and the inner cylindrical surface portion are formed in a single piece resulting from machining one and the same member, the holder has a seal member which contacts the engine block only at a diametrical surface of the engine block, the holder however does not contact the engine block at an axial surface of the engine block, the diametrical surface of the engine block extends along a direction that is more similar to a direction of a longitudinal axis of the plunger than to a direction that is perpendicular to the direction of the longitudinal axis of the plunger, and the axial surface of the engine block extends along a direction that is more similar to the direction that is perpendicular to the direction of the longitudinal axis of the plunger than to the direction of the longitudinal axis of the plunger, and the cylinder has a cylinder small-diameter portion axially projecting into the pressurizing chamber and radially facing an inner circumferential surface of the pump housing and a cylinder large-diameter portion that is: i) larger in diameter than the cylinder small-diameter portion, ii) the largest overall diameter of cylinder, and iii) closer to the engine block than the cylinder small-diameter portion.

16. The high-pressure fuel pump according to claim 1, wherein the holder is structurally configured to define an empty space that separates the holder from the plunger, the empty space being greater in length than a length of the inner cylindrical surface portion.

17. The high-pressure fuel pump according to claim 13, wherein the holder is structurally configured to define an empty space that separates the holder from the plunger, the empty space being greater in length than a length of the-inner cylindrical surface portion.

18. The high-pressure fuel pump according to claim 1, further comprising:

a flange securing the high-pressure fuel pump to the axial surface of the engine block, wherein the flange is welded from the engine block side and joined with the pump housing.

19. The high-pressure fuel pump according to claim 1, further comprising:

a flange securing the high-pressure fuel pump to the axial surface of the engine block, wherein a first end of the flange is welded via a welded portion, and a void is defined between the welded portion and the engine block.

* * * * *